US009971262B2

(12) United States Patent
Hasegawa et al.

(10) Patent No.: US 9,971,262 B2
(45) **Date of Patent: *May 15, 2018**

(54) MAGNETIC TONER

(71) Applicant: CANON KABUSHIKI KAISHA, Tokyo (JP)

(72) Inventors: Yusuke Hasegawa, Suntou-gun (JP); Tomohisa Sano, Mishima (JP); Shuichi Hiroko, Tokyo (JP); Yoshitaka Suzumura, Mishima (JP); Keisuke Tanaka, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/694,800

(22) Filed: Apr. 23, 2015

(65) Prior Publication Data

US 2015/0227067 A1 Aug. 13, 2015

Related U.S. Application Data

(63) Continuation of application No. PCT/JP2014/084064, filed on Dec. 24, 2014.

(30) Foreign Application Priority Data

Dec. 26, 2013 (JP) ..... 2013-269142

(51) Int. Cl.
*G03G 9/083* (2006.01)
*G03G 9/087* (2006.01)
(Continued)

(52) U.S. Cl.
CPC ..... *G03G 9/0833* (2013.01); *G03G 9/0821* (2013.01); *G03G 9/0827* (2013.01);
(Continued)

(58) Field of Classification Search
CPC ..... G03G 9/083; G03G 9/0836
See application file for complete search history.

(56) References Cited

U.S. PATENT DOCUMENTS 5,456,990 A 10/1995 Takagi et al.
5,508,139 A 4/1996 Tanaka et al.
(Continued)

FOREIGN PATENT DOCUMENTS

EP 2 312 399 4/2011
JP 6-273974 A 9/1994
(Continued)

*Primary Examiner* — Hoa V Le
(74) *Attorney, Agent, or Firm* — Fitzpatrick Cella Harper and Scinto

(57) ABSTRACT

A magnetic toner containing a magnetic toner particle having a binder resin and a magnetic body, and inorganic fine particles, wherein when the inorganic fine particles are classified as first inorganic fine particles, second inorganic fine particles, and third inorganic fine particles in accordance with fixing strength thereof to the magnetic toner particle and in the sequence of the weakness of the fixing strength, the content of the first inorganic fine particles, the ratio of the second inorganic fine particles to the first inorganic fine particles, and the coverage ratio X of coverage of the magnetic toner surface by the third inorganic fine particles are in prescribed ranges.

12 Claims, 5 Drawing Sheets

(51) Int. Cl.
*G03G 9/097* (2006.01)
*G03G 9/08* (2006.01)

(52) U.S. Cl.
CPC ..... *G03G 9/0834* (2013.01); *G03G 9/0835* (2013.01); *G03G 9/0836* (2013.01); *G03G 9/08782* (2013.01); *G03G 9/08795* (2013.01); *G03G 9/09708* (2013.01); *G03G 9/09725* (2013.01)

(56) References Cited

U.S. PATENT DOCUMENTS

| | | | | |
|---|---|---|---|---|
| 7,160,660 | B2 | 1/2007 | Dojo et al. | |
| 7,273,686 | B2 * | 9/2007 | Onuma | G03G 9/0817 430/106.1 |
| 7,368,211 | B2 | 5/2008 | Hasegawa et al. | |
| 7,470,494 | B2 | 12/2008 | Nishiyama et al. | |
| 7,678,524 | B2 | 3/2010 | Hasegawa et al. | |
| 7,935,467 | B2 | 5/2011 | Dojo et al. | |
| 7,939,231 | B2 | 5/2011 | Ogawa et al. | |
| 8,227,162 | B2 | 7/2012 | Sano et al. | |
| 8,426,091 | B2 | 4/2013 | Magome et al. | |
| 8,426,094 | B2 | 4/2013 | Magome et al. | |
| 8,518,620 | B2 | 8/2013 | Dojo et al. | |
| 8,728,693 | B2 | 5/2014 | Hamano et al. | |
| 8,918,035 | B2 | 12/2014 | Hasegawa et al. | |
| 9,097,997 | B2 * | 8/2015 | Nomura | G03G 9/083 |
| 9,152,065 | B2 * | 10/2015 | Sano | G03G 9/0833 |
| 9,213,251 | B2 * | 12/2015 | Ohmori | G03G 9/0821 |
| 9,244,371 | B2 * | 1/2016 | Suzumura | G03G 9/0835 |
| 9,417,542 | B2 * | 8/2016 | Hiroko | G03G 9/0833 |
| 9,423,710 | B2 | 8/2016 | Magome et al. | |
| 9,454,096 | B2 | 9/2016 | Hasegawa et al. | |
| 2006/0121379 | A1 | 6/2006 | Dojo et al. | |
| 2009/0197192 | A1 | 8/2009 | Hiroko et al. | |
| 2012/0214097 | A1 * | 8/2012 | Naka | G03G 9/107 430/111.32 |
| 2013/0164671 | A1 * | 6/2013 | Matsui | G03G 9/0802 430/123.56 |
| 2013/0236824 | A1 * | 9/2013 | Yoon | G03G 9/08 430/108.6 |
| 2014/0302433 | A1 | 10/2014 | Hasegawa et al. | |
| 2014/0315125 | A1 | 10/2014 | Matsui et al. | |
| 2014/0315126 | A1 | 10/2014 | Magome et al. | |
| 2014/0322639 | A1 | 10/2014 | Suzumura et al. | |
| 2014/0322640 | A1 | 10/2014 | Tanaka et al. | |
| 2014/0335449 | A1 | 11/2014 | Uratani et al. | |
| 2014/0335450 | A1 | 11/2014 | Nomura et al. | |
| 2014/0342277 | A1 | 11/2014 | Ohmori et al. | |
| 2014/0342278 | A1 | 11/2014 | Sano et al. | |
| 2014/0370431 | A1 | 12/2014 | Hiroko et al. | |
| 2015/0227068 | A1 * | 8/2015 | Sano | G03G 9/0835 430/108.3 |

FOREIGN PATENT DOCUMENTS

| | | | |
|---|---|---|---|
| JP | 2002-62683 | A | 2/2002 |
| JP | 2005-134751 | A | 5/2005 |
| JP | 2009-186812 | A | 8/2009 |
| JP | 2009-229785 | A | 10/2009 |
| JP | 04385507 | | 12/2009 |
| JP | 2010-60768 | A | 3/2010 |
| JP | 2010-160234 | A | 7/2010 |
| JP | 2012-203368 | A | 10/2012 |
| JP | 2013-134447 | | 7/2013 |
| JP | 2013-152460 | A | 8/2013 |
| JP | 05-367150 | | 12/2013 |
| RU | 2 477 506 | | 3/2013 |

* cited by examiner

MAGNETIC TONER

This application is a continuation of International Application No. PCT/JP2014/084064, filed Dec. 24, 2014, the contents of which are incorporated by reference herein.

TECHNICAL FIELD

The present invention relates to a magnetic toner used in, for example, electrophotographic methods, electrostatic recording methods, and magnetic recording methods.

BACKGROUND ART

Image-forming apparatuses, e.g., copiers and printers, have in recent years been subjected to greater diversity in their intended uses and use environments as well as demands for greater speed, higher image quality, and greater stability. For example, printers, which in the past have been used mainly in the office, have also entered into use in severe environments, e.g., high temperatures, high humidities, and it is also critical in such instances that a stable image quality be provided.

Copiers and printers are also undergoing apparatus downsizing as well as advances in energy efficiency, and the use is preferred within this context of magnetic single-component developing systems that use a favorable magnetic toner.

In a magnetic single-component developing system, a magnetic toner layer is formed by a toner layer thickness control member (referred to herebelow as the developing blade) on a toner-bearing member (referred to herebelow as the developing sleeve) that is provided in its interior with a magnetic field-generating means such as a magnetic roll. Development is carried out by transporting this magnetic toner layer to the developing zone using the developing sleeve.

Charge is imparted to the magnetic toner by the friction generated when the developing blade and the developing sleeve come into contact in the contact region between the developing blade and the developing sleeve (referred to herebelow as the blade nip region).

Reducing the diameter of the developing sleeve is a critical technology for reducing the size of the apparatus. With such a reduced-diameter developing sleeve, the developing zone at the developing nip region is narrowed and fly over by the magnetic toner from the developing sleeve is then impaired and a portion of the magnetic toner will readily remain on the developing sleeve.

In this case, turn over of the magnetic toner in the magnetic toner layer within the blade nip deteriorates and the charging performance of the magnetic toner layer readily becomes nonuniform.

Moreover, when an extended durability test is carried out in such a state, the magnetic toner in the blade nip region is readily subjected to shear and deterioration phenomena then readily occur, for example, the external additive at the magnetic toner surface becomes buried. As a consequence, the flowability and the charging performance of the magnetic toner are prone to decline in the latter half of an extended durability test that uses a small-diameter sleeve, and the charging performance in particular readily becomes nonuniform.

In addition, these deterioration phenomena are particularly prone to occur with magnetic toners in high-temperature, high-humidity environments, and systems in which the process speed has been raised in support of the higher speeds of recent years will only continue to be more stringent with regard to charging performance uniformity.

In particular, with magnetic toners the dispersibility of the magnetic body readily exercises a substantial effect on charging performance uniformity, as compared to magnetic body-free nonmagnetic toners, and various image defects are readily produced when the magnetic toner has an inferior charging performance uniformity.

For example, the overcharged magnetic toner fraction remains on the developing sleeve, and as a result the image density is prone to decline and image defects, such as fogging in nonimage areas, can occur.

In addition, due to the influence of the curvature of a reduced-diameter sleeve, it is difficult to stir the magnetic toner at the back of the developing sleeve. When the flowability of the magnetic toner is unsatisfactory, the magnetic toner compacted at the back of the developing sleeve assumes a packed condition and a state may be assumed in which the magnetic toner cannot be satisfactorily fed to the developing sleeve.

In this case the magnetic toner in the vicinity of the developing sleeve becomes overcharged and the charging performance uniformity of the magnetic toner then readily becomes unsatisfactory due to the transport of the magnetic toner to the blade nip region in a state of nonuniform charge.

To respond to this problem, numerous methods have been proposed in which the dielectric properties, which are an index for the state of the dispersion of the magnetic body within a magnetic toner, are controlled in order to bring about a stabilization of the changes in the developing performance that accompany changes in the environment.

For example, in Patent Document 1 the dielectric loss tangent (tan δ) in a high-temperature range and the normal temperature range is controlled in an attempt to reduce the variations in toner charging performance associated with variations in the environment.

While certain effects are in fact obtained under certain prescribed conditions, in particular adequate consideration is not given to a high degree of starting material dispersity for the case of a high magnetic body content, and there is still room for improvement with regard to the charging performance uniformity of magnetic toners.

In order to suppress environmental variations by toners, Patent Document 2 discloses a toner for which the ratio between the saturation water content HL under low-temperature, low-humidity conditions and the saturation water content HH under high-temperature, high-humidity conditions is brought into a prescribed range.

This control of the water content does in fact provide certain effects for the image density reproducibility and transferability under certain prescribed conditions, but in particular no mention is made of the charging performance uniformity when the magnetic body is incorporated as a colorant in the reasonable amount, and this is inadequate for obtaining the effects of the present invention.

Patent Document 3 discloses an image-forming apparatus that contains toner particles as well as spherical particles that have a number-average particle diameter of from at least 50 nm to not more than 300 nm, wherein the free ratio of these spherical particles is from at least 5 volume % to not more than 40 volume %. This has a certain effect with regard to inhibiting, under a prescribed environment, contamination of the image carrier, scratching of the image carrier and intermediate transfer member, and image defects.

Patent Document 4, on the other hand, discloses a toner in which large-diameter particles are anchored and small-diameter particles are externally added. This supports an improvement in the fixing releasability and a stabilization of the toner flowability and makes it possible to obtain a pulverized toner with excellent charging, transport, and release properties.

Patent Document 5 discloses an art in which the coating state for the external additive is controlled and the dielectric properties of the toner are also controlled and that is effective mainly for the issue of streak prevention.

In these inventions, however, the free ratio of the spherical particles or large-diameter particles, as inferred from the anchoring conditions or free conditions of these particles, is relatively high, and control of the state of fixing of inorganic fine particles that are otherwise added is inadequate.

Due to this, the charging performance uniformity for magnetic toners is inadequate, for example, when an extended durability test is run in a high-temperature, high-humidity environment—where charging is already prone to become nonuniform, and the effects sought by the present invention are not obtained.

That is, there is still room for improvement to obtain, through the use of a magnetic toner that has a satisfactory charging performance uniformity, a high quality image even after an extended durability test in a system with a fast process speed in support of higher speeds and using a reduced-diameter sleeve in support of apparatus downsizing.

CITATION LIST

Patent Literature

[PTL 1] Japanese Patent Application Laid-open No. 2005-134751

[PTL 2] Japanese Patent Application Laid-open No. 2009-229785

[PTL 3] Japanese Patent Application Laid-open No. 2009-186812

[PTL 4] Japanese Patent Application Laid-open No. 2010-60768

[PTL 5] Japanese Patent Application Laid-open No. 2013-152460

SUMMARY OF INVENTION

Technical Problems

An object of the present invention is to provide a magnetic toner that can solve the problems identified above, and specifically is to provide a magnetic toner that, regardless of the use environment, exhibits an excellent charging performance uniformity.

An additional object of the present invention is to provide a magnetic toner that has a satisfactory charging performance uniformity even after an extended durability test in a system with a fast process speed in support of higher speeds and using a reduced-diameter sleeve in support of apparatus downsizing. A further object of the present invention is to provide a magnetic toner that, regardless of the use environment and the circumstances of use, can suppress the image defects associated with charging nonuniformity.

Solution to Problem

The present inventors discovered that the problems could be solved by a fine control—through, for example, differences in the fixing strength—of the status of the inorganic fine particles that are added to a magnetic toner and achieved the present invention based on this discovery.

That is, the present invention is as follows.

A magnetic toner contains a magnetic toner particle that contains a binder resin and a magnetic body, and inorganic fine particles fixed to the surface of the magnetic toner particle, wherein when the inorganic fine particles are classified in accordance with fixing strength thereof to the magnetic toner particle and in the sequence of the weakness of the fixing strength, as first inorganic fine particles, the fixing strength thereof being weak, second inorganic fine particles, the fixing strength thereof being medium, and third inorganic fine particles, the fixing strength thereof being strong, 1) the content of the first inorganic fine particles is from at least 0.10 mass parts to not more than 0.30 mass parts in 100 mass parts of the magnetic toner;

2) the second inorganic fine particles are present at from at least 2.0-times to not more than 5.0-times the first inorganic fine particles; and 3) the coverage ratio X of coverage of the magnetic toner surface by the third inorganic fine particles, as determined with an x-ray photoelectron spectrometer (ESCA), is from at least 60.0 area % to not more than 90.0 area %, and wherein the first inorganic fine particles are inorganic fine particles that detach when a dispersion prepared by the addition of the magnetic toner to surfactant-containing ion-exchanged water is shaken for 2 minutes at a shaking velocity of 46.7 cm/sec and a shaking amplitude of 4.0 cm;

the second inorganic fine particles are inorganic fine particles that are not detached by the shaking, but are detached by ultrasound dispersion for 30 minutes at an intensity of 120 W/cm$^2$; and the third inorganic fine particles are inorganic fine particles that are not detached by the shaking and the ultrasound dispersion.

Advantageous Effects of Invention

The present invention can provide a magnetic toner that exhibits an excellent charging performance uniformity regardless of the use environment.

In addition, the present invention can provide a magnetic toner that has a satisfactory charging performance uniformity even after an extended durability test in a system with a fast process speed in support of higher speeds and using a reduced-diameter sleeve in support of apparatus downsizing. The present invention can further provide a magnetic toner that, regardless of the use environment and the circumstances of use, can suppress the image defects associated with charging nonuniformity.

DESCRIPTION OF EMBODIMENTS

Figure 1:
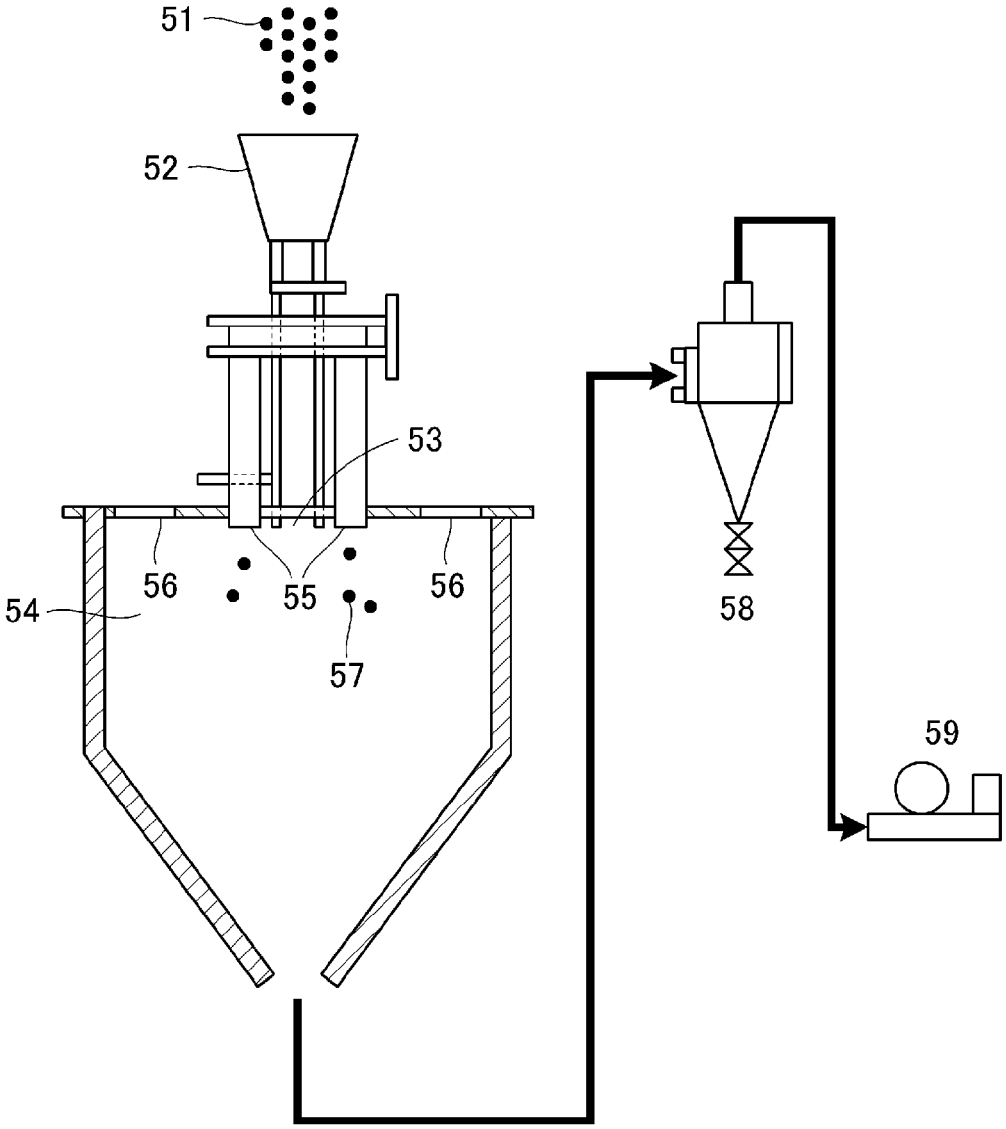
FIG. 1 is a diagram that shows an example of a surface modification apparatus that is preferably used in the present invention.

The present invention is described in detail herebelow.

The present invention relates to a magnetic toner that contains a magnetic toner particle containing a binder resin and a magnetic body, and inorganic fine particles fixed to the surface of the magnetic toner particle, wherein when the inorganic fine particles are classified in accordance with fixing strength thereof to the magnetic toner particle and in the sequence of the weakness of the fixing strength, as first inorganic fine particles, the fixing strength thereof being weak, second inorganic fine particles, the fixing strength thereof being medium, and third inorganic fine particles, the fixing strength thereof being strong, 1) the content of the first inorganic fine particles is from at least 0.10 mass parts to not more than 0.30 mass parts in 100 mass parts of the magnetic toner;

2) the second inorganic fine particles are present at from at least 2.0-times to not more than 5.0-times the first inorganic fine particles; and 3) the coverage ratio X of coverage of the magnetic toner surface by the third inorganic fine particles, as determined with an x-ray photoelectron spectrometer (ESCA), is from at least 60.0 area % to not more than 90.0 area %, and wherein the first inorganic fine particles are inorganic fine particles that are detached when a dispersion of the magnetic toner added to surfactant-containing ion-exchanged water is shaken for 2 minutes at a shaking velocity of 46.7 cm/sec and a shaking amplitude of 4.0 cm;

the second inorganic fine particles are inorganic fine particles that are not detached by the aforementioned shaking, but are detached by ultrasound dispersion for 30 minutes at an intensity of 120 W/cm$^2$; and the third inorganic fine particles are inorganic fine particles that are not detached by the aforementioned shaking and the aforementioned ultrasound dispersion.

According to investigations by the present inventors, a magnetic toner that exhibits an excellent charging performance uniformity—regardless of the use environment—can be provided by using the above-described magnetic toner.

In addition, a magnetic toner can be provided that has a satisfactory charging performance uniformity even after an extended durability test in a system with a fast process speed in support of higher speeds and using a reduced-diameter sleeve in support of apparatus downsizing. A magnetic toner can also be provided that, regardless of the use environment and the circumstances of use, can suppress the image defects associated with charging nonuniformity.

It is unclear as to why this charging performance uniformity can be provided through a fine control—through, for example, differences in the fixing strength—of the status of the inorganic fine particles that are added to a magnetic toner, but the present inventors hypothesize as follows.

First, it is crucial for the present invention that the coverage ratio X of the magnetic toner surface by the third inorganic fine particles, as determined with an x-ray photoelectron spectrometer (ESCA), be from at least 60.0 area % to not more than 90.0 area %. From at least 63.0 area % to not more than 85.0 area % is preferred and from at least 65.0 area % to not more than 80.0 area % is more preferred.

By having the coverage ratio X by the third inorganic fine particles be at least 60.0 area %, the magnetic toner particle surface is brought close to a surface having the character of the inorganic fine particles. This approach to a surface having the character of the inorganic fine particles can bring about a substantial improvement in the charging performance uniformity after the execution of an extended durability test.

The coverage ratio X can be controlled through, for example, the number-average particle diameter, amount of addition, external addition conditions, and so forth, for the third inorganic fine particles.

The reason for this is not exactly known, but the present inventors think as follows.

With reference to the surface of a magnetic toner particle, when a magnetic body and a binder resin and optionally a wax, charge control agent, and so forth are added, these are generally randomly present in the vicinity of the surface.

It is thought, on the other hand, that the uniformity of the surface composition is enhanced by having the third inorganic fine particles take up, as the value of the coverage ratio X, at least 60.0 area % of the surface of the magnetic toner particle.

It is thought that the charging performance uniformity for the magnetic toner as a whole, i.e., within the entire magnetic toner layer on the developing sleeve, is improved by the enhanced uniformity of the surface composition of the magnetic toner particle.

When the third inorganic fine particles are scarce, i.e., when the coverage ratio X by the third inorganic fine particles is less than 60.0 area %, what is known as selective development occurs during extended durability testing due to an inferior charging performance uniformity for the magnetic toner layer on the developing sleeve. As a result the charging performance of the magnetic toner after an extended durability test readily becomes nonuniform. Moreover, deterioration phenomena, such as the external additive at the magnetic toner surface becoming buried, are induced by the extended durability test, and due to this the flowability and charging performance of the magnetic toner readily decline and the charging performance readily becomes even more nonuniform.

By having the coverage ratio X by the third inorganic fine particles be at least 60.0 area %, the selective development is readily suppressed due to the enhanced uniformity of the magnetic toner particle surface.

In addition, the apparent hardness of the magnetic toner particle surface is increased by the third inorganic fine particles, and the deterioration phenomena associated with the embedding of the second inorganic fine particles and the first inorganic fine particles present at the magnetic toner surface is then readily suppressed, even when extended durability testing is carried out.

The result is thus considered to be a quite substantial improvement in the charging performance uniformity of the magnetic toner even after extended durability testing.

It is also crucial for the present invention that, in addition to the third (strongly fixed) inorganic fine particles on the magnetic toner surface, the second (medium-fixed) inorganic fine particles and first (weakly fixed) inorganic fine particles be present in suitable amounts.

Here, in order to maintain the charging performance uniformity to a high degree, it is crucial that the second inorganic fine particles and first inorganic fine particles satisfy the following conditions.

It is crucial for the magnetic toner of the present invention that the fixing status of the inorganic fine particles be controlled such that the second inorganic fine particles are present at from at least 2.0-times to not more than 5.0-times the first inorganic fine particles. The method for exercising this control can be exemplified by a method in which a two-stage mixing is implemented in the external addition step with adjustment of the amount of addition and the external addition strength for each of the inorganic fine particles in the first-stage external addition step and the second-stage external addition step.

The second inorganic fine particles are more preferably from at least 2.2-times to not more than 5.0-times and even more preferably from at least 2.5-times to not more than 5.0-times the first inorganic fine particles.

It is also crucial for the content of the first inorganic fine particles to be from at least 0.10 mass parts to not more than 0.30 mass parts in 100 mass parts of the magnetic toner. From at least 0.12 mass parts to not more than 0.27 mass parts is preferred and from at least 0.15 mass parts to not more than 0.25 mass parts is more preferred.

The method for controlling the content of the first inorganic fine particles into the indicated range can be exemplified by exercising control by adjusting the amount of addition of the inorganic fine particles and adjusting the respective first stage and second stage external addition conditions using the two-stage mixing referenced above.

While the method for measuring the amount of first inorganic fine particles is described below, it is thought that the first inorganic fine particles can behave relatively freely at the magnetic toner surface. It is thought that the lubricity within the magnetic toner can be raised and a cohesive force-reducing effect can be exhibited by having the first inorganic fine particles be present at from at least 0.10 mass parts to not more than 0.30 mass parts in 100 mass parts of the magnetic toner.

This lubricity and cohesive force-reducing effect is not obtained to a satisfactory degree at less than 0.10 mass parts. At above 0.30 mass parts, the lubricity readily becomes higher than necessary and the magnetic toner is prone to become densely congested and the flowability is then conversely prone to decline. In this case a compacted condition is readily assumed and the magnetic toner at the back of the developing sleeve readily becomes packed.

While the method for measuring the second inorganic fine particles is also described below, it is thought that the second inorganic fine particles, while being more embedded than the first inorganic fine particles, are more exposed at the magnetic toner particle surface than are the third inorganic fine particles.

The present inventors hypothesize that these second inorganic fine particles, due to their status of being suitably exposed while also being anchored, exert the effect of causing rotation of the magnetic toner when the magnetic toner is in a compacted state, for example, within the blade nip or at the back of the developing sleeve. When this occurs, not only does the magnetic toner rotate, but it is thought that, through interactions such as an intermeshing with the second silica fine particles on the surface of other magnetic toner particles, an effect accrues whereby the other magnetic toner particles are also induced to rotate.

That is, it is thought that, through a substantial mixing of the magnetic toner within the magnetic toner layer at the blade nip region as brought about by the action of the second inorganic fine particles, turn over of the magnetic toner in the blade nip region is promoted and the magnetic toner is then uniformly charged.

Furthermore, due to the strong stirring of the magnetic toner not just at the blade nip region, but also at the back of the developing sleeve, where compaction and packing of the magnetic toner can readily occur, it is thought that the magnetic toner is then favorably fed to the developing sleeve, contributing to the formation of a uniform magnetic toner layer.

When the magnetic toner compacted at the back of the developing sleeve assumes a packed condition and magnetic toner is not fed to the developing sleeve in a favorable manner, the magnetic toner in the vicinity of the developing sleeve becomes excessively charged and transport to the blade nip region of magnetic toner in a state of nonuniform charge then readily occurs.

As a result, even if the magnetic toner in the blade nip region has been turned over to a certain degree, the charging performance uniformity of the magnetic toner readily becomes unsatisfactory.

In order for the action of the second inorganic fine particles to be maximally expressed, it is critical that the state of fixing of the inorganic fine particles be controlled so that, as previously indicated, the second inorganic fine particles are present at from at least 2.0-times to not more than 5.0-times the first inorganic fine particles.

When the second inorganic fine particles and the first inorganic fine particles reside in the indicated quantitative ratio relationship, for the first time a uniform magnetic toner layer is formed on the developing sleeve by the magnetic toner at the back of the developing sleeve, and the magnetic toner is also strongly stirred at the blade nip region. It is thought that this functions to substantially improve the charging performance uniformity of the magnetic toner in the magnetic toner layer on the developing sleeve.

When the second inorganic fine particles exceed 5.0-times the first inorganic fine particles, the actions with regard to lubricity and reducing the cohesive forces become weaker than the intermeshing action due to the second inorganic fine particles and the stirring effects at the back of the developing sleeve and the blade nip region are not obtained.

When, on the other hand, the second inorganic fine particles are less than 2.0-times the first inorganic fine particles, the intermeshing action by the second inorganic fine particles is not adequately obtained and, as above, the stirring effect again cannot be adequately obtained.

These effects can be obtained for the first time when the coverage ratio X by the third inorganic fine particles is from at least 60.0 area % to not more than 90.0 area %.

When the coverage ratio X by the third inorganic fine particles exceeds 90.0 area %, it then becomes quite difficult to control the quantitative ratio relationship between the second inorganic fine particles and the first inorganic fine particles into the range of the present invention, even using the inorganic fine particle external addition methods described below.

In addition, the apparent hardness of the magnetic toner particle surface becomes excessively high, and as a result the low-temperature fixability is readily impaired, thus making this unfavorable.

The present inventors experimentally discovered that the ratio of the number-average particle diameter (D1) of the primary particles of the third inorganic fine particles to the number-average particle diameter (D1) of the primary particles of the first inorganic fine particles (D1 of the third inorganic fine particles/D1 of the first inorganic fine particles) is preferably from at least 4.0 to not more than 25.0, is more preferably from at least 5.0 to not more than 20.0, and even more preferably is from at least 6.0 to not more than 15.0.

The reason for this is not clear, but the following is hypothesized.

It is thought that the utilization of a sliding action between the inorganic fine particles present on the magnetic toner particle surfaces is very effective for inducing an even greater expression of the lubricity improvement within the magnetic toner and the cohesive force-reducing effect that are brought about, as discussed above, by the first inorganic fine particles.

To this end, moreover, it is thought that the sliding action can be maximally utilized when the area occupied by a primary particle of the third inorganic fine particles, which are strongly fixed to the magnetic toner particle surface, is larger than for the first inorganic fine particles, which are capable of a relatively free behavior.

When the ratio of the number-average particle diameter (D1) of the primary particles of the third inorganic fine particles to the number-average particle diameter (D1) of the primary particles of the first inorganic fine particles is less than 4.0, it then tends to be difficult to obtain the sliding action between inorganic fine particles to a satisfactory extent.

When, on the other hand, this ratio exceeds 25.0, it then tends to be difficult, due to the large area occupied by a primary particle of the third inorganic fine particles, to satisfy the preferred quantitative ratio relationship between the second inorganic fine particles and the first inorganic fine particles.

This ratio can be controlled through a suitable selection of the number-average particle diameter of the inorganic fine particles that are caused to be strongly fixed and the number-average particle diameter of the inorganic fine particles that are caused to be weakly fixed.

The number-average particle diameter (D1) of the primary particles of the third inorganic fine particles is preferably from at least 50 nm to not more than 200 nm, more preferably from at least 60 nm to not more than 180 nm, and even more preferably from at least 70 nm to not more than 150 nm.

When the number-average particle diameter (D1) of the primary particles of the third inorganic fine particles is less than 50 nm, it is then difficult to obtain the sliding action mentioned above to a satisfactory degree and it also tends to be difficult to suppress the embedding of the first inorganic fine particles and second inorganic fine particles that accompanies extended durability testing.

On the other hand, it tends to be difficult to adjust the coverage ratio X of the magnetic toner surface by the third inorganic fine particles to equal to or greater than 60.0 area % when the number-average particle diameter (D1) of the primary particles of the third inorganic fine particles exceeds 200 nm.

The number-average particle diameter (D1) of the primary particles of the third inorganic fine particles can be controlled through judicious selection of the inorganic fine particles that are caused to be strongly fixed.

The number-average particle diameter (D1) of the primary particles of the first inorganic fine particles and/or the second inorganic fine particles is preferably from at least 5 nm to not more than 30 nm. From at least 5 nm to not more than 25 nm is more preferred, and from at least 5 nm to not more than 20 nm is even more preferred.

By satisfying this range, the lubricity and cohesive force-reducing effect are readily expressed with the first inorganic fine particles. The intermeshing-induced stirring effect on the magnetic toner is readily expressed with the second inorganic fine particles.

The magnetic toner of the present invention preferably has a dielectric constant ε' at a frequency of 100 kHz and a temperature of 30° C. of from at least 30.0 pF/m to not more than 40.0 pF/m. In addition, the dielectric loss tangent (tan δ) is preferably not more than $9.0\times10^{-3}$. More preferably, ε' is from at least 32.0 pF/m to not more than 38.0 pF/m and the dielectric loss tangent (tan δ) is not more than $8.5\times10^{3}$.

Here, the frequency condition for measuring the dielectric constant is made 100 kHz because this is a favorable frequency for detecting the state of dispersion of the magnetic body. When the frequency is lower than 100 kHz, it is difficult to make consistent measurements and there is a tendency for dielectric constant differences between magnetic toners to be obscured. In addition, when measurements were performed at 120 kHz, approximately the same values were consistently obtained as at 100 kHz, while there was a tendency at frequencies higher than this for dielectric constant differences between magnetic toners with different properties to be somewhat small. With regard to the use of a temperature of 30° C., this is a temperature that can represent the magnetic toner properties from low to high temperatures for the temperatures assumed within the cartridge during image printing.

Dielectric properties that support facile charging of the magnetic toner are obtained by having the dielectric constant ε' be in the indicated range. Moreover, by controlling tan δ to a relatively low value, charge leakage is suppressed since the magnetic body is uniformly dispersed to a high degree in the magnetic toner.

That is, it is thought that by preferably controlling ε' and tan δ into the ranges according to the present invention, the properties accrue of facile magnetic toner particle charging and a suppression of charge leakage, which also result in an even greater improvement in the charging performance uniformity.

The dielectric properties of the magnetic toner can be adjusted through, for example, the selection of the binder resin, the acid value of the magnetic toner, and the magnetic body content.

For example, the use of a high content of a polyester component for the binder resin for the magnetic toner can provide a relatively high ε' and thus facilitates control into the previously indicated range.

In addition, a small ε' can be obtained by having a low acid value for the resin component of the magnetic toner or by using a small magnetic body content in the magnetic toner, while, conversely, a large ε' can be obtained by having a high acid value for the resin component or by using a large magnetic body content in the magnetic toner.

A low dielectric loss tangent (tan δ) can be obtained, on the other hand, through the uniform dispersion of the magnetic body in the magnetic toner, and, for example, the uniform dispersion of the magnetic body can be promoted by raising the kneading temperature during melt kneading (for example, to at least 160° C.) to lower the viscosity of the kneadate.

The binder resin for the magnetic toner in the present invention may be one or more selections from, for example, vinylic resins, polyester resins, epoxy resins, and polyurethane resins, but is not particularly limited and the heretofore known resins may be used. Among these, the incorporation of a polyester resin or a vinylic resin is preferred from the standpoint of the co-existence of the charging performance and fixing performance in good balance, and in particular the use of a polyester resin as the major component of the binder resin is preferred from the standpoint of the low-temperature fixability and from the standpoint of controlling to the dielectric properties preferred for the present invention. The composition of this polyester resin is as follows.

The major component of the binder resin is defined in the present invention as being at least equal to or greater than 50 mass % in the binder resin.

The dihydric alcohol component constituting the polyester resin can be exemplified by one or more selections from ethylene glycol, propylene glycol, butanediol, diethylene glycol, triethylene glycol, pentanediol, hexanediol, neopentyl glycol, hydrogenated bisphenol A, bisphenols represented by the following formula (A) and their derivatives, and diols represented by the following formula (B)

[C1]

(A)

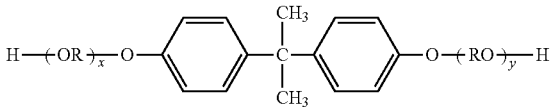

(in the formula, R is the ethylene group or propylene group; x and y are each integers equal to or greater than 0; and the average value of x+y is from at least 0 to not more than 10)

[C2]

(B)

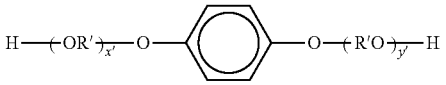

(in the formula, R' is

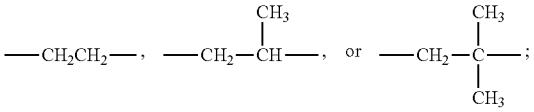

x' and y' are integers equal to or greater than 0; and the average value of x'+y' is from at least 0 to not more than 10).

The dibasic acid component constituting this polyester resin can be exemplified by one or more selections from benzenedicarboxylic acids such as phthalic acid, terephthalic acid, isophthalic acid, and phthalic anhydride; alkyl dicarboxylic acids such as succinic acid, adipic acid, sebacic acid, and azelaic acid; alkenylsuccinic acids such as n-dodecenylsuccinic acid; and unsaturated dicarboxylic acids such as fumaric acid, maleic acid, citraconic acid, and itaconic acid.

One or more selections from an at least trihydric alcohol component and/or an at least tribasic acid component, which components function as a crosslinking component, may also be used.

The at least trihydric polyhydric alcohol component can be exemplified by sorbitol, pentaerythritol, dipentaerythritol, tripentaerythritol, butanetriol, pentanetriol, glycerol, methylpropanetriol, trimethylolethane, trimethylolpropane, and trihydroxybenzene.

The at least tribasic polybasic carboxylic acid component for the present invention can be exemplified by trimellitic acid, pyromellitic acid, benzenetricarboxylic acid, butanetricarboxylic acid, hexanetricarboxylic acid, and the tetracarboxylic acid represented by the following formula (C)

[C3]

(C)

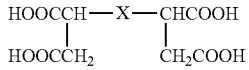

(in the formula, X represents a $C_{5-30}$ alkylene group or alkenylene group having at least one side chain having at least 3 carbons).

The vinylic resin can be favorably exemplified by styrenic resins.

The styrenic resins can be specifically exemplified by polystyrene and by styrenic copolymers such as styrene-propylene copolymers, styrene-vinyltoluene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-octyl methacrylate copolymers, styrene-butadiene copolymers, styrene-isoprene copolymers, styrene-maleic acid copolymers, and styrene-maleate ester copolymers. A single one of these may be used or a combination of a plurality may be used.

The glass transition temperature (Tg) of the magnetic toner of the present invention is preferably from at least 45° C. to not more than 65° C. It is more preferably from at least 50° C. to not more than 65° C. A glass transition temperature of from at least 45° C. to not more than 65° C. is preferred because this can provide an improved storage stability and developing performance durability while maintaining an excellent fixability.

The glass transition temperature of a resin or a magnetic toner can be measured based on ASTM D3418-82 using a differential scanning calorimeter, for example, a DSC-7 from PerkinElmer Inc. or the DSC2920 from TA Instruments Japan Inc.

The acid value of the magnetic toner of the present invention is preferably from at least 10 mg KOH/g to not more than 40 mg KOH/g. From at least 10 mg KOH/g to not more than 35 mg KOH/g is more preferred, and from at least 10 mg KOH/g to not more than 30 mg KOH/g is even more preferred. Adjustment to the dielectric properties preferred for the magnetic toner in the present invention is facilitated by controlling the acid value into the indicated range.

Moreover, the charging performance uniformity is readily improved by having the acid value be from at least 10 mg KOH/g to not more than 40 mg KOH/g.

In order to control this acid value into the indicated range, the acid value of the binder resin used in the present invention is preferably from at least 10 mg KOH/g to not more than 40 mg KOH/g. The acid value of the binder resin can be controlled, for example, through the monomer selection and the polymerization conditions for the resin. The details of the method for measuring the acid value are described below.

When the acid value of the magnetic toner is less than 10 mg KOH/g, depending on the extended durability test use conditions the magnetic toner is prone to becoming overcharged and there is a tendency for charging to be nonuniform.

When the acid value of the magnetic toner exceeds 40 mg KOH/g, the hygroscopicity is prone to rise and due to this there is a tendency, just as above, for charging to be nonuniform depending on the extended durability test use conditions.

Viewed in terms of the low-temperature fixability, the magnetic toner of the present invention preferably contains an ester compound as a release agent and the magnetic toner preferably has a maximum endothermic peak at from at least 50° C. to not more than 80° C. in measurement using a differential scanning calorimeter (DSC).

More preferably this ester compound is a monofunctional ester compound having from at least 32 to not more than 48 carbons. Specific examples are saturated fatty acid monoesters such as palmityl palmitate, stearyl stearate, and behenyl behenate.

Specific examples of other release agents that can be used in the present invention are petroleum waxes such as paraffin waxes, microcrystalline waxes, and petrolatum, and their derivatives; montan wax and its derivatives; hydrocarbon waxes provided by the Fischer-Tropsch process and their derivatives; polyolefin waxes as typified by polyethylene and polypropylene, and their derivatives; natural waxes such as carnauba wax and candelilla wax, and their derivatives; and ester waxes. The derivatives here include the oxides, block copolymers with vinylic monomers, and graft modifications.

In addition to the monofunctional ester compounds cited above, multifunctional ester compounds, such as most prominently difunctional ester compounds but also tetrafunctional and hexafunctional ester compounds, may also be used as the ester compound. Specific examples are diesters between saturated aliphatic dicarboxylic acids and saturated aliphatic alcohols, e.g., dibehenyl sebacate, distearyl dodecanedioate, and distearyl octadecanedioate; diesters between saturated aliphatic diols and saturated fatty acids, such as nonanediol dibehenate and dodecanediol distearate; triesters between trialcohols and saturated fatty acids, such as glycerol tribehenate and glycerol tristearate; and partial esters between trialcohols and saturated fatty acids, such as glycerol monobehenate and glycerol dibehenate. A single one of these release agents may be used or two or more may be used in combination.

However, with such multifunctional ester compounds, bleeding to the magnetic toner surface readily occurs when the hot air current-mediated surface modification process described below is performed, which results in a tendency for the charging performance uniformity and development performance durability to readily decline.

When a release agent is used in the magnetic toner of the present invention, from at least 0.5 mass parts to not more than 10 mass parts of the release agent is preferably used per 100 mass parts of the binder resin. From at least 0.5 mass parts to not more than 10 mass parts is preferred for improving the low-temperature fixability without impairing the storage stability of the magnetic toner. These release agents can be incorporated in the binder resin by, for example, methods in which, at the time of resin production, the resin is dissolved in a solvent, the temperature of the resin solution is raised, and addition and mixing are carried out while stirring, and methods in which addition is carried out during melt-kneading during magnetic toner production.

Viewed from the perspective of facilitating control such that the magnetic toner has a maximum endothermic peak at from at least 50° C. to not more than 80° C. in measurement with a differential scanning calorimeter (DSC), the maximum endothermic peak temperature for the release agent is preferably from at least 50° C. to not more than 80° C.

By having the maximum endothermic peak of the magnetic toner in the present invention be at from at least 50° C. to not more than 80° C., the magnetic toner is then easily plasticized during fixing and the low-temperature fixability is enhanced. It is also preferred because bleed out by the release agent is suppressed, even during long-term storage, while at the same time the developing performance durability is readily maintained. The magnetic toner more preferably has a maximum endothermic peak at from at least 53° C. to not more than 75° C.

Measurement of the peak top temperature of the maximum endothermic peak is carried out in the present invention based on ASTM D3418-82 using a "Q1000" differential scanning calorimeter (TA Instruments). Temperature correction in the instrument detection section is performed using the melting points of indium and zinc, and the amount of heat is corrected using the heat of fusion of indium.

Specifically, approximately 10 mg of the magnetic toner is accurately weighed out and this is introduced into an aluminum pan, and the measurement is run at a ramp rate of 10° C./minute in the measurement temperature range between 30 to 200° C. using an empty aluminum pan as reference. The measurement is carried out by initially raising the temperature to 200° C., then cooling to 30° C., and then reheating. The peak top temperature of the maximum endothermic peak for the magnetic toner is determined from the DSC curve in the 30 to 200° C. temperature range in this second ramp-up process.

The magnetic body incorporated in the magnetic toner in the present invention can be exemplified by iron oxides such as magnetite, maghemite, and ferrite; metals such as iron, cobalt, and nickel; alloys of these metals with metals such as aluminum, copper, magnesium, tin, zinc, beryllium, calcium, manganese, selenium, titanium, tungsten, and vanadium; and mixtures of the preceding.

The number-based number-average primary particle diameter (D1) of the magnetic body is preferably not greater than 0.50 μm and is more preferably from 0.05 μm to 0.30 μm.

In addition, viewed in terms of facilitating control to the magnetic properties preferred for the magnetic toner in the present invention, the magnetic properties of the magnetic body are preferably controlled to the following for a magnetic field of 79.6 kA/m.

That is, the coercive force (Hc) is preferably 1.5 to 6.0 kA/m and is more preferably 2.0 to 5.0 kA/m; the saturation magnetization ($\sigma s$) is preferably 40 to 80 $Am^2/kg$ (more preferably 50 to 70 $Am^2/kg$); and the residual magnetization ($\sigma r$) is preferably 1.5 to 6.5 $Am^2/kg$ and is more preferably 2.0 to 5.5 $Am^2/kg$.

The magnetic toner of the present invention preferably contains from at least 35 mass % to not more than 50 mass % of the magnetic body and more preferably contains from at least 40 mass % to not more than 50 mass %. When the magnetic body content in the magnetic toner is less than 35 mass %, the magnetic attraction to the magnet roll within the developing sleeve is reduced and there is a tendency for the fogging to worsen. When, on the other hand, the magnetic body content exceeds 50 mass %, the density may decline due to a decline in the developing performance.

The magnetic body content in the magnetic toner can be measured using, for example, a TGA Q5000IR thermal analyzer from PerkinElmer Inc. With regard to the measurement method, the magnetic toner is heated from normal temperature to 900° C. at a ramp rate of 25° C./minute under a nitrogen atmosphere, and the mass loss from 100 to 750° C. is taken to be the mass of the component from the magnetic toner excluding the magnetic body and the remaining mass is taken to be the amount of the magnetic body.

The magnetic toner of the present invention preferably has, for a magnetic field of 79.6 kA/m, a saturation magnetization (σs) of from at least 30.0 $Am^2/kg$ to not more than 40.0 $Am^2/kg$ and more preferably from at least 32.0 $Am^2/kg$ to not more than 38.0 $Am^2/kg$. In addition, the ratio [σr/σs] of the residual magnetization (σr) to the saturation magnetization (σs) is preferably from at least 0.03 to not more than 0.10 and is more preferably from at least 0.03 to not more than 0.06.

The saturation magnetization (σs) can be controlled, through, for example, the particle diameter, shape, and added elements for the magnetic body.

The residual magnetization σr is preferably not more than 3.0 $Am^2/kg$ and is more preferably not more than 2.6 $Am^2/kg$ and is even more preferably not more than 2.4 $Am^2/kg$. A small σr/σs means a small residual magnetization for the magnetic toner.

In a magnetic single-component developing system, the magnetic toner is captured by or ejected from the developing sleeve through the effect of the multipole magnet resident within the developing sleeve. The ejected magnetic toner (the magnetic toner detached from the developing sleeve) resists magnetic cohesion when σr/σs is small. Since such a magnetic toner resides in a magnetic cohesion-resistant state when attached to the developing sleeve by the recapture pole and entered into the blade nip region, regulation of the magnetic toner layer thickness can be advantageously carried out and the amount of the magnetic toner on the developing sleeve is then stable. Due to this, turn over of the magnetic toner at the blade nip region is strongly stabilized and the charging uniformity is easily improved still further.

[σr/σs] can be adjusted into the indicated range by adjusting the particle diameter and shape of the magnetic body incorporated in the magnetic toner and by adjusting the additives that are added during production of the magnetic body. Specifically, through the addition of, for example, silica or phosphorus to the magnetic body, a high σs can be held intact while σr can be brought down. In addition, a smaller surface area for the magnetic body provides a smaller σr, and, with regard to shape, σr is smaller for a spherical shape, which has a smaller magnetic anisotropy than an octahedron. A combination of these makes it possible to achieve a major reduction in σr and thus enables σr/σs to be controlled to equal to or less than 0.10.

The saturation magnetization (σs) and residual magnetization (σr) of the magnetic toner and magnetic body are measured in the present invention at an external magnetic field of 79.6 kA/m at a room temperature of 25° C. using a VSM P-1-10 vibrating magnetometer (Toei Industry Co., Ltd.). The reason for carrying out the measurement at an external magnetic field of 79.6 kA/m is as follows. The magnetic force of the development pole of the magnet roller fixed in the developing sleeve is generally around 79.6 kA/m (1000 oersted). Due to this, the behavior of the magnetic toner in the developing zone can be understood by measuring the residual magnetization at an external magnetic field of 79.6 kA/m.

A charge control agent is preferably added to the magnetic toner of the present invention. A negative-charging toner is preferred in the present invention because the binder resin itself has a high negative chargeability.

For example, organometal complex compounds and chelate compounds are effective as negative-charging charge control agents, and examples thereof are monoazo metal complex compounds, acetylacetone metal complex compounds, and the metal complex compounds of aromatic hydroxycarboxylic acids and aromatic dicarboxylic acids.

Negative-charging charge control agents can be exemplified by Spilon Black TRH, T-77, and T-95 (Hodogaya Chemical Co., Ltd.) and by BONTRON (registered trademark) S-34, S-44, S-54, E-84, E-88, and E-89 (Orient Chemical Industries Co., Ltd.).

A single one of these charge control agents may be used or a combination of two or more may be used. Viewed in terms of the amount of charge on the magnetic toner, the use amount for these charge control agents, expressed per 100 mass parts of the binder resin, is preferably 0.1 to 10.0 mass parts and is more preferably 0.1 to 5.0 mass parts.

The inorganic fine particles fixed to the magnetic toner particle surface are preferably at least one selection from silica fine particles, titania fine particles, and alumina fine particles. Since these inorganic fine particles are similar in terms of hardness and their effect with regard to improving toner flowability, a uniform charging performance is readily obtained by controlling the state of fixing to the magnetic toner particle surface.

Silica fine particles preferably account for at least 85 mass % of the total amount of the inorganic fine particles present in the magnetic toner. This is because silica fine particles have the best charging characteristics among the inorganic fine particles referenced above and thus support facile expression of the effects of the present invention.

In addition to the inorganic fine particles having a controlled fixing strength as described in the preceding, other organic and inorganic fine particles may be added to the magnetic toner of the present invention. For example, the following may also be used in small amounts to the extent that the effects of the present invention are not affected: lubricants such as fluororesin powder, zinc stearate powder, and polyvinylidene fluoride powder; abrasives such as cerium oxide powder, silicon carbide powder, and the fine particles of alkaline-earth metal titanate salts and specifically strontium titanate fine particles, barium titanate fine particles, and calcium titanate fine particles; and spacer particles such as silica.

When silica fine particles are selected as the inorganic fine particles to be subjected to fixing strength control, the magnetic toner of the present invention also more preferably additionally contains titania fine particles.

Overcharging of the magnetic toner is readily inhibited and in addition the flowability is readily improved due to the addition of the titania fine particles, and as a consequence additional improvements in the charging performance uniformity of the magnetic toner are readily achieved. When a two-stage mixing is carried out, the titania fine particles are preferably added in the second-stage external addition step.

In order for the titania fine particles and fixing strength-controlled inorganic fine particles to impart an excellent flowability to the magnetic toner, their specific surface area as measured by the BET method based on nitrogen adsorption (BET specific surface area) is preferably from at least 20 $m^2/g$ to not more than 350 $m^2/g$ and is more preferably from at least 25 $m^2/g$ to not more than 300 $m^2/g$.

This measurement of the specific surface area (BET specific surface area) by the BET method using nitrogen adsorption is carried out based on JIS Z 8830 (2001). A "TriStar 3000 Automatic Specific Surface Area•Pore Distribution Analyzer" (Shimadzu Corporation), which uses a constant-volume gas adsorption procedure as its measurement principle, is used as the measurement instrumentation.

The fixing strength-controlled inorganic fine particles, titania fine particles, and other inorganic fine particles have preferably been subjected to a hydrophobic treatment, and it is particularly preferred that the hydrophobic treatment be carried out so as to provide a degree of hydrophobicity, as measured by the methanol titration test, of preferably at least 40% and more preferably at least 50%.

The method for carrying out the hydrophobic treatment can be exemplified by methods in which the treatment is carried out using, for example, an organosilicon compound, a silicone oil, or a long-chain fatty acid.

The organosilicon compound here can be exemplified by hexamethyldisilazane, trimethylsilane, trimethylethoxysilane, isobutyltrimethoxysilane, trimethylchlorosilane, dimethyldichlorosilane, methyltrichlorosilane, dimethylethoxysilane, dimethyldimethoxysilane, diphenyldiethoxysilane, and hexamethyldisiloxane. A single one of these may be used or a mixture of two or more may be used.

The silicone oil here can be exemplified by dimethylsilicone oils, methylphenylsilicone oils, α-methylstyrene-modified silicone oils, chlorophenylsilicone oils, and fluorine-modified silicone oils.

A $C_{10-22}$ fatty acid is advantageously used for the long-chain fatty acid, and this may be a straight-chain fatty acid or a branched fatty acid. In addition, a saturated fatty acid or an unsaturated fatty acid may be used.

Among the preceding, $C_{10-22}$ straight-chain saturated fatty acids readily provide a uniform treatment of the inorganic fine particle surface and hence are highly preferred.

The straight-chain saturated fatty acid can be exemplified by capric acid, lauric acid, myristic acid, palmitic acid, stearic acid, arachidic acid, and behenic acid.

Silicone oil-treated silica fine particles are preferred among the inorganic fine particles that are used in the present invention. Silica fine particles that have been treated with a silicon compound and a silicone oil are more preferred because this supports a favorable control of the hydrophobicity.

The method for treating silica fine particles with silicone oil can be exemplified by methods in which a silicon compound-treated inorganic fine powder is directly mixed with a silicone oil in, for example, a Henschel mixer, and by methods in which the silicone oil is sprayed on an inorganic fine powder. Or, a method may be used in which a silicone oil is dissolved or dispersed in a suitable solvent; the inorganic fine powder is subsequently added thereto with mixing; and the solvent is removed.

In order to obtain an excellent hydrophobicity, the amount of treatment with the silicone oil, expressed per 100 mass parts of the silica fine particles, is preferably from at least 1 mass parts to not more than 40 mass parts and is more preferably from at least 3 mass parts to not more than 35 mass parts.

Viewed in terms of the balance between the developing performance and the fixing performance, the weight-average particle diameter (D4) of the magnetic toner of the present invention is preferably from at least 7.0 μm to not more than 12.0 μm, is more preferably from at least 7.5 μm to not more than 11.0 μm, and is even more preferably from at least 7.5 μm to not more than 10.0 μm.

The average circularity of the magnetic toner of the present invention is preferably from at least 0.955 to not more than 0.980 and is more preferably from at least 0.957 to not more than 0.980.

By having the average circularity of the magnetic toner be at least 0.955, a toner surface configuration that presents few depressed portions can be obtained and the fixing status of the third inorganic fine particles and the second inorganic fine particles can be easily controlled, making this preferred.

The average circularity of the magnetic toner of the present invention can be adjusted into the indicated range through the method for producing the magnetic toner and through adjustment of the production conditions.

Examples of methods for producing the magnetic toner of the present invention are provided herebelow, but this is not intended as a limitation thereto.

The magnetic toner of the present invention may be produced by any known method without particular limitation as long as the production method has a step that can adjust the fixing status of inorganic fine particles and that preferably has a step in which the average circularity can be adjusted.

Such production methods can be favorably exemplified by the following method. First, the binder resin and magnetic body and other optional materials such as a release agent and charge control agent are thoroughly mixed using a mixer such as a Henschel mixer or ball mill, and this is followed by melting and kneading using a heated kneader such as a roll, kneader, or extruder to induce miscibilization between the resins.

After cooling and solidification, the obtained melt kneadate is coarsely pulverized, finely pulverized, and classified to obtain magnetic toner particles, and the magnetic toner can then be obtained by the external addition with mixing of an external additive, e.g., inorganic fine particles, to the obtained magnetic toner particles.

The mixer here can be exemplified by the Henschel mixer (Mitsui Mining Co., Ltd.); Supermixer (Kawata Mfg. Co., Ltd.); Ribocone (Okawara Corporation); Nauta mixer, Turbulizer, and Cyclomix (Hosokawa Micron Corporation); Spiral Pin Mixer (Pacific Machinery & Engineering Co., Ltd.); and Loedige Mixer (Matsubo Corporation).

The kneader here can be exemplified by the KRC Kneader (Kurimoto, Ltd.); Buss Ko-Kneader (Buss Corp.); TEM extruder (Toshiba Machine Co., Ltd.); TEX twin-screw kneader (The Japan Steel Works, Ltd.); PCM Kneader (Ikegai Ironworks Corporation); three-roll mills, mixing roll mills, and kneaders (Inoue Manufacturing Co., Ltd.); Kneadex (Mitsui Mining Co., Ltd.); model MS pressure kneader and Kneader-Ruder (Moriyama Mfg. Co., Ltd.); and Banbury mixer (Kobe Steel, Ltd.). The pulverizer can be exemplified by the Counter Jet Mill, Micron Jet, and Inomizer (Hosokawa Micron Corporation); IDS mill and PJM Jet Mill (Nippon Pneumatic Mfg. Co., Ltd.); Cross Jet Mill (Kurimoto, Ltd.); Ulmax (Nisso Engineering Co., Ltd.); SK Jet-O-Mill (Seishin Enterprise Co., Ltd.); Kryptron (Kawasaki Heavy Industries, Ltd.); Turbo Mill (Turbo Kogyo Co., Ltd.); and Super Rotor (Nisshin Engineering Inc.).

Among the preceding, the average circularity can be controlled by adjusting the exhaust gas temperature during fine pulverization using a Turbo Mill. A lower exhaust gas temperature (for example, no more than 40° C.) provides a smaller value for the average circularity while a higher exhaust gas temperature (for example, around 50° C.) provides a higher value for the average circularity.

The classifier can be exemplified by the Classiel, Micron Classifier, and Spedic Classifier (Seishin Enterprise Co., Ltd.); Turbo Classifier (Nisshin Engineering Inc.); Micron Separator, Turboplex (ATP), and TSP Separator (Hosokawa Micron Corporation); Elbow Jet (Nittetsu Mining Co., Ltd.); Dispersion Separator (Nippon Pneumatic Mfg. Co., Ltd.); and YM Microcut (Yasukawa Shoji Co., Ltd.).

Screening devices that can be used to screen the coarse particles can be exemplified by the Ultrasonic (Koei Sangyo Co., Ltd.), Rezona Sieve and Gyro-Sifter (Tokuju Corporation), Vibrasonic System (Dalton Co., Ltd.), Soniclean (Sintokogio, Ltd.), Turbo Screener (Turbo Kogyo Co., Ltd.), Microsifter (Makino Mfg. Co., Ltd.), and circular vibrating sieves.

To prepare the magnetic toner according to the present invention, the previously described constituent materials of the magnetic toner are thoroughly mixed with a mixer and subsequently thoroughly kneaded using kneader, and, after cooling and solidification, coarse pulverization is carried out followed by fine pulverization and classification to obtain magnetic toner particles. As necessary, the classification step may be followed by surface modification and adjustment of the average circularity of the magnetic toner particles using a surface modification apparatus to obtain the final magnetic toner particles.

After the magnetic toner particles have been obtained, the magnetic toner according to the present invention can be produced by adding the inorganic fine particles and performing an external addition and mixing process, preferably using the mixing process apparatus described below.

A step in the production of a particularly preferred magnetic toner in the present invention can be exemplified by a hot air current process step in which, for example, surface modification of the magnetic toner particle is carried out by instantaneously blowing a high-temperature hot air current onto the magnetic toner particle surface and immediately thereafter cooling the magnetic toner particle with a cold air current.

The modification of the toner particle surface by such a hot air current process step, because it avoids the application of excessive heat to the magnetic toner particle, can provide surface modification of the magnetic toner particle while preventing deterioration of the raw material components and also supports facile adjustment to the average circularity preferred for the present invention.

For example, a surface modification apparatus as shown in FIG. 1 may be used in the hot air current process step for the magnetic toner particle. Using an autofeeder 52, the magnetic toner particle 51 is passed through a feed nozzle 53 and is fed in a prescribed amount to the surface modification apparatus interior 54. Because the surface modification apparatus interior 54 is suctioned by a blower 59, the magnetic toner particles 51 introduced from the feed nozzle 53 are dispersed in the interior of the apparatus. The magnetic toner particles 51 dispersed in the interior of the apparatus undergo surface modification through the instantaneous application of heat by a hot air current that is introduced from a hot air current introduction port 55. The hot air current is produced by a heater in the present invention, but there is no particular limitation on the apparatus as long as it can produce a hot air current sufficient to effect surface modification of the magnetic toner particle.

The temperature of the hot air current is preferably 180 to 400° C. and is more preferably 200 to 350° C.

The flow rate of the hot air current is preferably 4 $m^3$/min to 10 $m^3$/min and is more preferably 5 $m^3$/min to 8 $m^3$/min.

The flow rate of the cold air current is preferably 2 $m^3$/min to 6 $m^3$/min and is more preferably 3 $m^3$/min to 5 $m^3$/min.

The blower air flow rate is preferably 10 $m^3$/min to 30 $m^3$/min and is more preferably 12 $m^3$/min to 25 $m^3$/min.

The injection air flow rate is preferably 0.2 $m^3$/min to 3 $m^3$/min and is more preferably 0.5 $m^3$/min to 2 $m^3$/min. The surface-modified magnetic toner particle 57 is instantaneously cooled by a cold air current introduced from a cold air current introduction port 56. Liquid nitrogen is used for the cold air current in the present invention, but there is no particular limitation on the means as long as the surface-modified magnetic toner particle 57 can be instantaneously cooled. The temperature of the cold air current is preferably 2 to 15° C. and is more preferably 2 to 10° C. The surface-modified magnetic toner particles 57 are suctioned off by the blower 59 and are collected by a cyclone 58.

This hot air current process step is in particular highly preferred in the present invention from the standpoint of adjusting the fixing status of the third inorganic fine particles. Adjustment of the fixing status of the third inorganic fine particles can be specifically carried out as follows.

The magnetic toner particles are first subjected to the external addition and mixing process with the inorganic fine particles using a mixer as described above to obtain pre-hot air current process magnetic toner particles. The pre-hot air current process magnetic toner particles are subsequently fed to the surface modification apparatus shown in FIG. 1 and, through the execution of the hot air current process as described above, the inorganic fine particles that have been externally added and mixed are strongly fixed by being covered by the binder resin, which has been semi-melted by the hot air current. The magnetic toner particle is preferably subjected to such an external addition and mixing process with the inorganic fine particles and to the hot air current process. This is preferably followed by an additional external addition and mixing with inorganic fine particles.

At this time the state of fixing of the third inorganic fine particles can be adjusted through the selection of the inorganic fine particles added to the pre-hot air current process magnetic toner particle and adjustment of their amount of addition and also through optimization of the process conditions in the hot air current process.

In particular, execution of the hot air current process is preferred in order to bring the coverage ratio X by the third inorganic fine particles, which is an important characteristics feature of the present invention, to at least 60.0 area %. However, the present invention is not limited to or by this.

An external addition and mixing process apparatus preferred in the present invention is described below.

Figure 2:
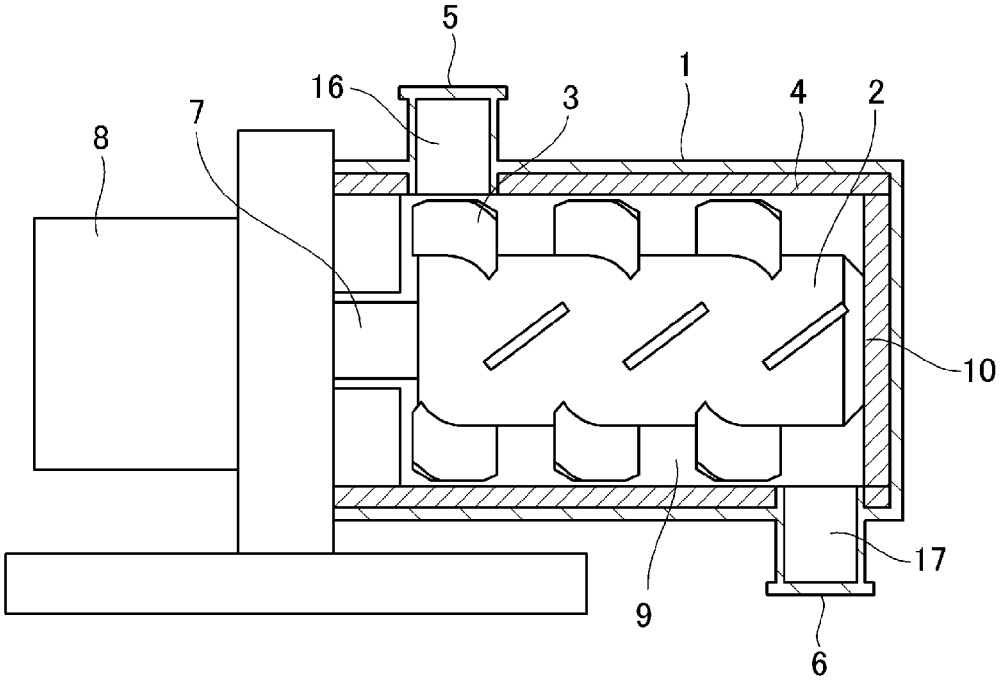
FIG. 2 is a schematic diagram that shows an example of a mixing process apparatus that can be used for the external addition and mixing of inorganic fine particles.

The use of the following external addition and mixing process apparatus as shown in FIG. 2 is strongly preferred in order to have the second inorganic fine particles and first inorganic fine particles satisfy the previously described states when the coverage ratio X by the third inorganic fine particles is the at least 60.0 area % of the present invention. This mixing process apparatus can bring about fixing of inorganic fine particles to the toner particle surface, while reducing secondary particles to primary particles, because it has a structure that applies shear in a narrow clearance region to the magnetic toner particles and the inorganic fine particles. As a consequence, the amounts of the first inorganic fine particles and second inorganic fine particles are readily controlled even when the coverage ratio by the third inorganic fine particles is at least 60.0 area % as in the present invention, and this is thus strongly preferred.

Furthermore, as described below, control to a state of inorganic fine particle fixing preferred in the present invention is easily achieved because circulation of the magnetic toner particles and inorganic fine particles in the axial direction of the rotating member is facilitated and because a thorough and uniform mixing is facilitated prior to the development of fixing.

Figure 3:
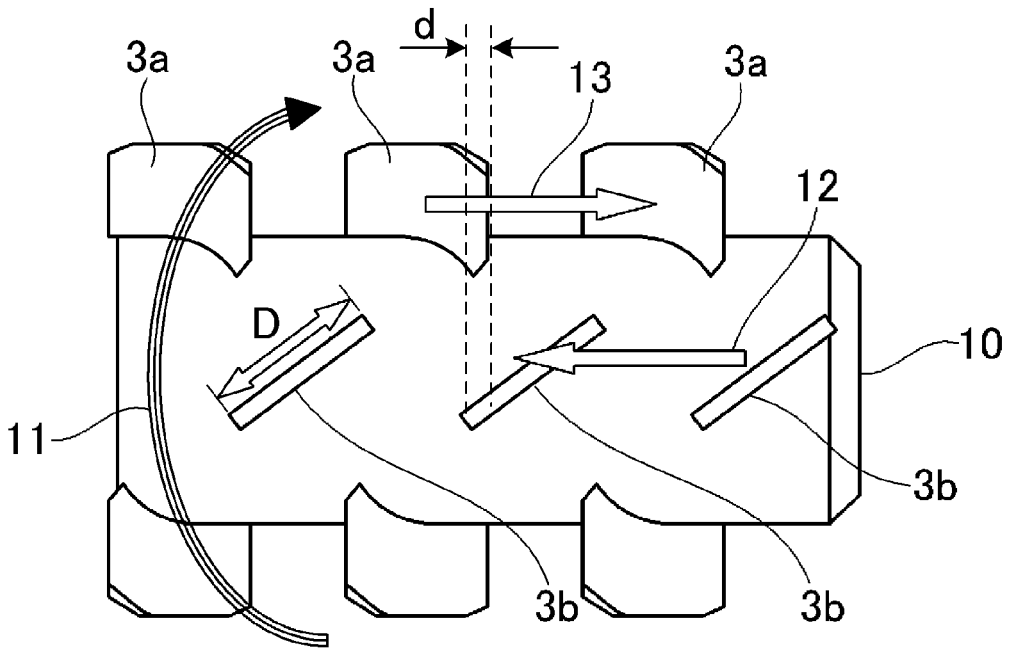
FIG. 3 is a schematic diagram that shows an example of the structure of the stirring member that is used in the mixing process apparatus.

FIG. 3, on the other hand, is a schematic diagram that shows an example of the structure of the stirring member used in the aforementioned mixing process apparatus. The aforementioned external addition and mixing process for inorganic fine particles is described in the following using FIGS. 2 and 3.

This mixing process apparatus that carries out external addition and mixing of the inorganic fine particles has a rotating member 2, on the surface of which at least a plurality of stirring members 3 are disposed; a drive member 8, which drives the rotation of the rotating member; and a main casing 1, which is disposed to have a gap with the stirring members 3.

The gap (clearance) between the inner circumference of the main casing 1 and the stirring member 3 is preferably maintained constant and very small in order to apply a uniform shear to the magnetic toner particles and facilitate the fixing of the inorganic fine particles to the magnetic toner particle surface while reducing secondary particles to primary particles.

The diameter of the inner circumference of the main casing 1 in this apparatus is not more than twice the diameter of the outer circumference of the rotating member 2. An example is shown in FIG. 2 in which the diameter of the inner circumference of the main casing 1 is 1.7-times the diameter of the outer circumference of the rotating member 2 (the trunk diameter provided by excluding the stirring members 3 from the rotating member 2). When the diameter of the inner circumference of the main casing 1 is not more than twice the diameter of the outer circumference of the rotating member 2, impact force is satisfactorily applied to the inorganic fine particles that have become secondary particles, since the processing space in which forces act on the magnetic toner particles is suitably limited.

In addition, the clearance is preferably adjusted in conformity to the size of the main casing. Adequate shear can be applied to the inorganic fine particles by making it approximately from at least 1% to not more than 5% of the diameter of the inner circumference of the main casing 1. Specifically, when the diameter of the inner circumference of the main casing 1 is approximately 130 mm, the clearance is preferably made approximately from at least 2 mm to not more than 5 mm; when the diameter of the inner circumference of the main casing 1 is about 800 mm, the clearance is preferably made approximately from at least 10 mm to not more than 30 mm.

In the process of the external addition and mixing of the inorganic fine particles in the present invention, mixing and external addition of the inorganic fine particles to the magnetic toner particle surface are performed using the mixing process apparatus by rotating the rotating member 2 by the drive member 8 and stirring and mixing the magnetic toner particles and inorganic fine particles that have been introduced into the mixing process apparatus.

As shown in FIG. 3, at least a portion of the plurality of stirring members 3 is formed as a forward transport stirring member 3*a* that, accompanying the rotation of the rotating member 2, transports the magnetic toner particles and inorganic fine particles in one direction along the axial direction of the rotating member. In addition, at least a portion of the plurality of stirring members 3 is formed as a back transport stirring member 3*b* that, accompanying the rotation of the rotating member 2, returns the magnetic toner particles and inorganic fine particles in the other direction along the axial direction of the rotating member.

Here, when a raw material inlet port 5 and a product discharge port 6 are disposed at the two ends of the main casing 1, as in FIG. 2, the direction toward the product discharge port 6 from the raw material inlet port 5 (the direction to the right in FIG. 3) is the "forward direction".

That is, as shown in FIG. 3, the face of the forward transport stirring member 3*a* is tilted so as to transport the magnetic toner particles and the inorganic fine particles in the forward direction (13). On the other hand, the face of the back transport stirring member 3*b* is tilted so as to transport the magnetic toner particles and the inorganic fine particles in the back direction (12).

By doing this, the external addition of the inorganic fine particles to the magnetic toner particle surface and mixing are carried out while repeatedly performing transport in the "forward direction" (13) and transport in the "back direction" (12).

In addition, with regard to the stirring members 3*a* and 3*b*, a plurality of members disposed at intervals in the circumferential direction of the rotating member 2 form a set. In the example shown in FIG. 3, two members at an interval of 180° with each other form a set of the stirring members 3*a*, 3*b* on the rotating member 2, but a larger number of members may form a set, such as three at an interval of 120° or four at an interval of 90°.

In the example shown in FIG. 3, a total of twelve stirring members 3*a*, 3*b* are formed at an equal interval.

Furthermore, D in FIG. 3 indicates the width of a stirring member and d indicates the distance that represents the overlapping portion of a stirring member. In FIG. 3, D is preferably a width that is approximately from at least 20% to not more than 30% of the length of the rotating member 2, when considered from the standpoint of bringing about an efficient transport of the magnetic toner particles and inorganic fine particles in the forward direction and back direction. FIG. 3 shows an example in which D is 23%. Furthermore, when an extension line is drawn in the perpendicular direction from the position of the end of the stirring member 3*a*, the stirring members 3*a* and 3*b* preferably have a certain overlapping portion d of the stirring member 3*a* with the stirring member 3*b*. This makes it possible to efficiently apply shear to the inorganic fine particles that have become secondary particles. This d is preferably from at least 10% to not more than 30% of D from the standpoint of the application of shear.

In addition to the shape shown in FIG. 3, the blade shape may be—insofar as the magnetic toner particles can be transported in the forward direction and back direction and the clearance is retained—a shape having a curved surface or a paddle structure in which a distal blade element is connected to the rotating member 2 by a rod-shaped arm.

The present invention will be described in additional detail herebelow with reference to the schematic diagrams of the apparatus shown in FIGS. 2 and 3. The apparatus shown in FIG. 2 has a rotating member 2, which has at least a plurality of stirring members 3 disposed on its surface; a drive member 8 that drives the rotation of the rotating member 2; and a main casing 1, which is disposed forming a gap with the stirring members 3. It also has a jacket 4, in which a heat transfer medium can flow and which resides on the inside of the main casing 1 and at the end surface 10 of the rotating member 2.

In addition, the apparatus shown in FIG. 2 has a raw material inlet port 5, which is formed on the upper side of the main casing 1 for the purpose of introducing the magnetic toner particles and the inorganic fine particles, and has a product discharge port 6, which is formed on the lower side of the main casing 1 for the purpose of discharging, from the main casing 1 to the outside, the magnetic toner that has been subjected to the external addition and mixing process.

The apparatus shown in FIG. 2 also has a raw material inlet port inner piece 16 inserted in the raw material inlet port 5 and a product discharge port inner piece 17 inserted in the product discharge port 6. In the present invention, the raw material inlet port inner piece 16 is first removed from the raw material inlet port 5 and the magnetic toner particles are introduced into the processing space 9 from the raw material inlet port 5. Then, the inorganic fine particles are introduced into the processing space 9 from the raw material inlet port 5 and the raw material inlet port inner piece 16 is inserted. The rotating member 2 is subsequently rotated by the drive member 8 (11 represents the direction of rotation), and the thereby introduced material to be processed is subjected to the external addition and mixing process while being stirred and mixed by the plurality of stirring members 3 disposed on the surface of the rotating member 2. The sequence of introduction may also be introduction of the inorganic fine particles through the raw material inlet port 5 first and then introduction of the magnetic toner particles through the raw material inlet port 5. In addition, the magnetic toner particles and the inorganic fine particles may be mixed in advance using a mixer such as a Henschel mixer and the mixture may thereafter be introduced through the raw material inlet port 5 of the apparatus shown in FIG. 2.

In addition, since the coverage ratio X by the third inorganic fine particles is at least 60.0 area % in the present invention, a two-stage mixing is preferably carried out in which the magnetic toner particles and a portion of the inorganic fine particles are mixed at one time followed by the further addition and mixing of the remaining inorganic fine particles.

This two-stage mixing is preferred because it facilitates control of the fixing of the inorganic fine particles, for example, it facilitates the efficient formation of the medium-attached inorganic fine particles, and does so even for a magnetic toner particle surface with a high apparent hardness, which is resistant to inorganic fine particle fixing.

In particular, the use of an external addition and mixing process apparatus as in FIG. 2 is preferred for obtaining the appropriate amount of second inorganic fine particles. However, the present invention is not limited to or by this.

More specifically, with regard to the conditions for the external addition and mixing process, controlling the power of the drive member 8 to from at least 0.2 W/g to not more than 2.0 W/g is preferred in terms of controlling the fixing as described above.

When the power is lower than 0.2 W/g, it is then difficult to form the second inorganic fine particles and it may not be possible to control to a preferred state of inorganic fine particle fixing for the present invention. On the other hand, at above 2.0 W/g there is a tendency for the inorganic fine particles to end up being excessively embedded.

The processing time is not particularly limited, but is preferably from at least 3 minutes to not more than 10 minutes.

The rotation rate of the stirring members during external addition and mixing is not particularly limited. For the apparatus shown in FIG. 2 in which the volume of the processing space 9 of the apparatus is $2.0\times10^{-3}$ $m^3$, the rpm of the stirring members—when the shape of the stirring members 3 is as shown in FIG. 3—is preferably from at least 800 rpm to not more than 3000 rpm. The use of from at least 800 rpm to not more than 3000 rpm supports facile control to a preferred state of inorganic fine particle fixing for the present invention.

A particularly preferred processing method for the present invention has a pre-mixing step prior to the external addition and mixing process step. Inserting a pre-mixing step achieves a very uniform dispersion of the inorganic fine particles on the magnetic toner particle surface, and as a result control to a preferred state of inorganic fine particle fixing is even more readily achieved.

More specifically, the pre-mixing processing conditions are preferably a power at the drive member 8 of from at least 0.06 W/g to not more than 0.20 W/g and a processing time of from at least 0.5 minute to not more than 1.5 minutes. It tends to be difficult to obtain a satisfactorily uniform mixing in the pre-mixing when the loaded power is below 0.06 W/g or the processing time is shorter than 0.5 minute for the pre-mixing processing conditions. When, on the other hand, the loaded power is higher than 0.20 W/g or the processing time is longer than 1.5 minutes for the pre-mixing processing conditions, the inorganic fine particles may end up becoming fixed to the magnetic toner particle surface before a satisfactorily uniform mixing has been achieved.

For the apparatus shown in FIG. 2 in which the volume of the processing space 9 of the apparatus is $2.0\times10^{-3}$ $m^3$, the rpm of the stirring members in the pre-mixing process is preferably from at least 50 rpm to not more than 500 rpm for the rpm of the stirring members when the shape of the stirring members 3 is as shown in FIG. 3.

After the external addition and mixing process has been finished, the product discharge port inner piece 17 in the product discharge port 6 is removed and the rotating member 2 is rotated by the drive member 8 to discharge the magnetic toner from the product discharge port 6. As necessary, coarse particles and so forth may be separated from the obtained magnetic toner using a screen or sieve, for example, a circular vibrating screen, to obtain the magnetic toner.

Figure 4:
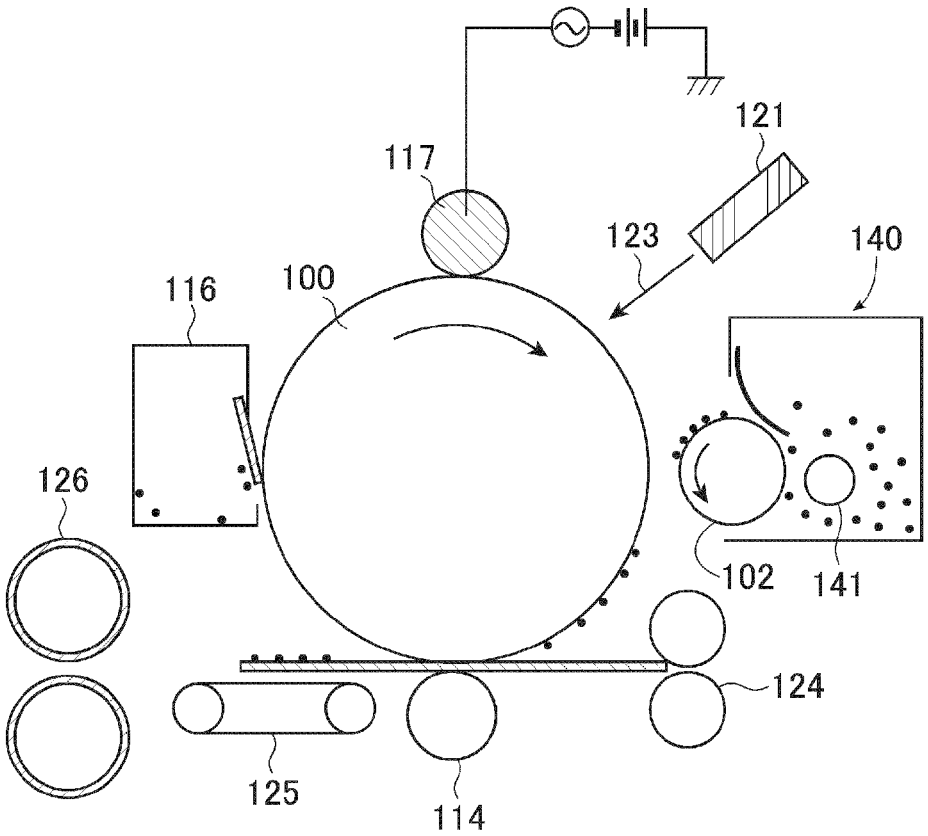
FIG. 4 is a diagram that shows an example of an image-forming apparatus.

An example of an image-forming apparatus that can advantageously use the magnetic toner of the present invention is specifically described below with reference to FIG. 4. In FIG. 4, 100 is an electrostatic latent image-bearing member (also referred to below as a photosensitive member), and the following, inter alia, are disposed on its circumference: a charging roller 117, a developing device 140 having a developing sleeve 102, a transfer charging roller 114, a cleaner container 116, a fixing unit 126, and a pick-up roller 124. The electrostatic latent image-bearing member 100 is charged by the charging roller 117. Photo-exposure is performed by irradiating the electrostatic latent image-bearing member 100 with laser light from a laser generator 121 to form an electrostatic latent image corresponding to the intended image. The electrostatic latent image on the electrostatic latent image-bearing member 100 is developed by the developing device 140 with a single-component toner to provide a toner image, and the toner image is transferred onto a transfer material by the transfer roller 114, which contacts the electrostatic latent image-bearing member with the transfer material interposed therebetween. The toner image-bearing transfer material is conveyed to the fixing unit 126 and fixing on the transfer material is carried out. In addition, the magnetic toner remaining to some extent on the electrostatic latent image-bearing member is scraped off by a cleaning blade and is stored in the cleaner container 116.

The methods for measuring the various properties pertinent to the present invention are described in the following.

<Methods for Measuring the Amounts of First and Second Inorganic Fine Particles>

The inorganic fine particles are fixed to the magnetic toner particle at three levels in the present invention, i.e., weak, medium, and strong. The amount of each is obtained by quantitatively determining the total amount of the inorganic fine particles contained in the magnetic toner and quantitating the inorganic fine particles that remain on the magnetic toner particle after inorganic fine particles have been detached from the magnetic toner. In the present invention, the process of detaching the inorganic fine particles is carried out by dispersing the magnetic toner in water and applying shear using a vertical shaker or an ultrasound disperser. At this time, the inorganic fine particles are classified into the different fixing strengths, e.g., weakly fixed or medium-fixed, using the magnitude of the shear applied to the magnetic toner, and the amounts thereof are obtained. A KM Shaker (Iwaki Industry Co., Ltd.) is used under the conditions given below to detach the first inorganic fine particles, while a VP-050 ultrasound homogenizer (Taitec Corporation) is used under the conditions given below to detach the second inorganic fine particles. The inorganic fine particle content is quantitatively determined using an Axios x-ray fluorescence analyzer (PANalytical) and using the "SuperQ ver. 4.0F" (PANalytical) dedicated software supplied therewith to set the measurement conditions and analyze the measurement data. The measurements were specifically carried out as follows.

(1) Quantitative Determination of the Inorganic Fine Particle Content in the Magnetic Toner Approximately 1 g of the magnetic toner is loaded in a vinyl chloride ring of ring diameter 22 mm×16 mm×5 mm and a sample is fabricated by compression at 100 kgf using a press. The obtained sample is measured using an x-ray fluorescence (XRF) analyzer (Axios) and analysis is performed using the software provided therewith to obtain the net intensity (A) of an element originating with the inorganic fine particles contained by the magnetic toner. Then, samples for calibration curve construction are prepared by shaking the inorganic fine particles at an amount of addition of 0.0 mass %, 1.0 mass %, 2.0 mass %, or 3.0 mass % with 100 mass parts of the magnetic toner particles, and, proceeding as described above, a calibration curve is constructed for the inorganic fine particle amount versus the net intensity of the element. Prior to the XRF measurement, the sample for calibration curve construction is mixed to uniformity using, for example, a coffee mill. The admixed inorganic fine particles do not influence this determination as long as the admixed inorganic fine particles have a primary particle number-average particle diameter of from at least 5 nm to not more than 50 nm. The amount of inorganic fine particles in the magnetic toner is determined from the calibration curve and the numerical value of (A).

In this procedure, the fine particles contained at the magnetic toner surface are first identified by elemental analysis. Here, for example, when silica fine particles are present, the inorganic fine particle content can be elucidated by preparing the samples for calibration curve construction using silica fine particles in the above-described procedure, and when titania fine particles are present the inorganic fine particle content can be elucidated by preparing the samples for calibration curve construction using titania fine particles in the above-described procedure.

(2) Quantitative Determination of the First Inorganic Fine Particles

A dispersion is prepared by introducing 20 g of ion-exchanged water and 0.4 g of the surfactant Contaminon N (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.) into a 30 mL glass vial (for example, VCV-30, outer diameter: 35 mm, height: 70 mm, from Nichiden-Rika Glass Co., Ltd.) and thoroughly mixing. A pre-processing dispersion A is prepared by adding 1.5 g of the magnetic toner to this vial and holding at quiescence until the magnetic toner has naturally sedimented. This is followed by shaking under the conditions given below to detach the first inorganic fine particles. The dispersion is then filtered with a vacuum filter to obtain a filter cake A and a filtrate A, and the filter cake A is dried for at least 12 hours in a dryer. The filter paper used in the vacuum filtration is No. 5C from ADVANTEC (particle retention capacity: 1 μm, corresponds to grade 5C in JIS P 3801 (1995)) or a filter paper equivalent thereto.

The material yielded by drying is measured and analyzed using the same x-ray fluorescence analyzer (Axios) as in (1), and the amount of inorganic fine particles detached by the shaking described below is calculated from the calibration curve data obtained in (1) and the difference between the obtained net intensity and the net intensity obtained in (1). That is, the first inorganic fine particles are defined to be the inorganic fine particles that are detached when the dispersion prepared by the addition of the magnetic toner to surfactant-containing ion-exchanged water is shaken under the following conditions.

[Shaker/Conditions]

apparatus: KM Shaker (Iwaki Industry Co., Ltd.)

model: V. SX shaking conditions: shaking for 2 minutes at a speed set to 50 (shaking speed: 46.7 cm/second, 350 back-and-forth excursions in 1 minute, shaking amplitude: 4.0 cm)

(3) Quantitative Determination of the Second Inorganic Fine Particles

After a pre-processing dispersion A has been prepared as described in (2) above, an ultrasound dispersion process is carried out under the conditions described below to detach the first and second inorganic fine particles contained by the magnetic toner. This is followed by filtration of the dispersion with a vacuum filter, drying, and measurement and analysis with an x-ray fluorescence analyzer (Axios) as described in (2). Here, the second inorganic fine particles were taken to be the inorganic fine particles that were not detached under the shaking conditions in (2), but were detached by the ultrasound dispersion under the conditions indicated below, while the third inorganic fine particles were taken to be the inorganic fine particles strongly fixed to the degree that they were not removed even by ultrasound dispersion under the conditions indicated below. The amount of third inorganic fine particles is obtained from the net intensity yielded by x-ray fluorescence analysis and the calibration curve data obtained in (1). The amount of second inorganic fine particles is obtained by subtracting the obtained amount of third inorganic fine particles and the amount of first inorganic fine particles obtained in (2) from the inorganic fine particle content obtained in (1).

Figure 5:
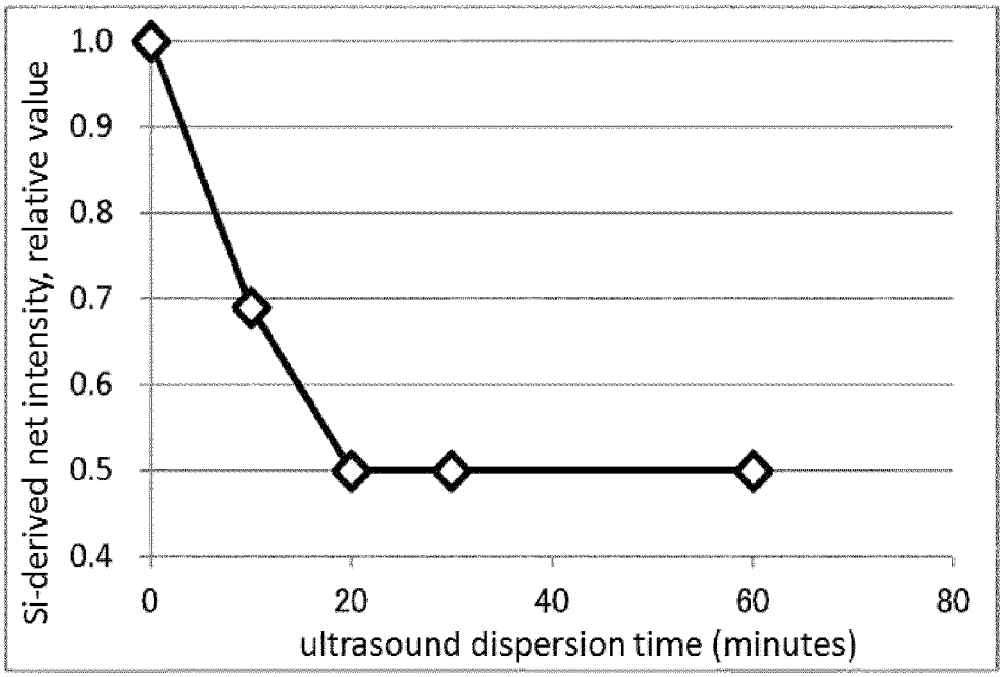
FIG. 5 is a diagram that shows an example of the relationship between the ultrasound dispersion time and the net intensity originating from Si.

The reason for a 30-minute dispersion in the dispersion conditions is as follows. FIG. 5 shows the relationship between the ultrasound dispersion time and the net intensity deriving from silica fine particles after ultrasound dispersion using the ultrasound homogenizer indicated below, for magnetic toner to which silica fine particles have been externally added at the three external additional strengths. The 0-minute dispersion time is the data after processing by the KM Shaker in (2). According to FIG. 5, detachment of the silica fine particles by ultrasound dispersion proceeds progressively and becomes approximately constant for all external addition strengths after an ultrasound dispersion for 20 minutes.

[Ultrasound Dispersion Apparatus/Conditions]

apparatus: VP-050 ultrasound homogenizer (TAITEC Corporation)

microtip: step-type microtip, 2 mmϕ tip diameter position of the tip of the microtip: center of the glass vial, height of 5 mm from the bottom of the vial ultrasound conditions: 30% intensity (15 W intensity, 120 W/cm$^2$), 30 minutes. The ultrasound is applied here while cooling the vial with ice water to prevent the dispersion from undergoing an increase in temperature.

<The Coverage Ratio X by the Third Inorganic Fine Particles>

The first and second inorganic fine particles are first removed by carrying out dispersion under the ultrasound dispersion conditions in "(3) Quantitative determination of the second inorganic fine particles" to prepare a sample in which only the third inorganic fine particles are fixed to the magnetic toner particle. The coverage ratio X of the magnetic toner surface by the third inorganic fine particles is then determined proceeding as described below. The coverage ratio X represents the percentage of the magnetic toner particle surface taken by the area covered by the third inorganic fine particles.

Elemental analysis of the surface of the indicated sample is carried out using the following instrumentation under the following conditions.

measurement instrumentation: Quantum 2000 x-ray photoelectron spectroscope (trade name, from Ulvac-Phi, Incorporated)

x-ray source: monochrome Al Kα x-ray setting: 100 μmϕ (25 W (15 KV))

photoelectron take-off angle: 45° neutralization conditions: combination of a neutralization gun and ion gun analysis region: 300×200 μm pass energy: 58.70 eV step size: 1.25 eV analytic software: Multipak (from PHI)

When silica fine particles had been selected for the third inorganic fine particles, C 1c (B. E. 280 to 295 eV), O 1s (B. E. 525 to 540 eV), and Si 2p (B. E. 95 to 113 eV) were used to calculate the quantitative value for the Si atom. The obtained quantitative value for the element Si is designated as Y1.

Elemental analysis of the silica fine particle itself is then carried out proceeding as for the previously described elemental analysis of the magnetic toner surface and the quantitative value for the element Si thereby obtained is designated as Y2.

The coverage ratio X of the magnetic toner surface by the inorganic fine particles is defined for the present invention by the following formula using this Y1 and Y2.

$$\text{coverage ratio}X(\text{area }\%)=(Y1/Y2)\times 100$$

In order to improve the accuracy of this measurement, measurement of Y1 and Y2 is preferably carried out at least twice. In the determination of the quantitative value Y2, the measurement is carried out using the inorganic fine particles used for the external addition if these can be obtained.

When titania fine particles (or alumina fine particles) have been selected for the third inorganic fine particles, the coverage ratio X can be similarly determined by determining the aforementioned parameters, Y1, and Y2 using the element Ti (or the element Al for alumina fine particles).

Here, when a plurality of inorganic fine particles have been selected for the third inorganic fine particles, for example, when silica fine particles and titania fine particles have been selected, the coverage ratio for each is determined and the inorganic fine particle coverage ratio can then be calculated by summing these.

When the inorganic fine particles are unknown, the third inorganic fine particles are isolated by carrying out the same procedure as in the method for measuring the number-average particle diameter (D1) of the primary particles of the third inorganic fine particles, infra. The obtained third inorganic fine particles are subjected to elemental analysis to identify an atom constituting these inorganic fine particles, and this is made the analytic target. For the first inorganic fine particles and second inorganic fine particles, the analytic targets can also be identified as necessary by isolation and execution of elemental analysis.

<The Method for Measuring the Number-Average Particle Diameter (D1) of the Primary Particles of the First and Second Inorganic Fine Particles>

The number-average particle diameter of the primary particles of the first and second inorganic fine particles is calculated from the image of the inorganic fine particles on the magnetic toner surface taken with Hitachi's S-4800 ultrahigh resolution field emission scanning electron microscope (Hitachi High-Technologies Corporation). The conditions for image acquisition with the S-4800 are as follows.

(1) Specimen Preparation (1-1) Preparation of the First Inorganic Fine Particle Sample A filtrate A is obtained by carrying out the same procedure as in the "(2) Quantitative determination of the first inorganic fine particles" above. The filtrate A is transferred to a swing rotor glass tube (50 mL) and separation is performed using a centrifugal separator at 3500 rpm for 30 minutes. After visually checking that the inorganic fine particles and aqueous solution have been well separated, the aqueous solution is removed by decantation. The inorganic fine particles that remain are recovered with, for example, a spatula, and are dried to obtain S-4800 observation sample A.

(1-2) Preparation of the Second Inorganic Fine Particle Sample

A filter cake A is obtained by carrying out the same procedure as in the "(2) Quantitative determination of the first inorganic fine particles" above. After this, a pre-processing dispersion B, in which the filter cake A has been allowed to naturally sediment, is obtained in the same manner as during the preparation of the pre-processing dispersion A in "(2) Quantitative determination of the first inorganic fine particles". The same ultrasound dispersion process as in the "(3) Quantitative determination of the second inorganic fine particles" above is run on this pre-processing dispersion B to detach the second inorganic fine particles present in the filter cake A. The dispersion is then filtered with a vacuum filter to obtain a filtrate B in which the second inorganic fine particles are dispersed. The filter paper used in the vacuum filtration is No. 5C from ADVANTEC (particle retention capacity: 1 μm, corresponds to grade 5C in JIS P 3801 (1995)) or a filter paper equivalent thereto. Following this, observation sample B is obtained proceeding as above in the preparation of the first inorganic fine particle sample.

(1-3) Preparation and Installation of the Specimen Stub

An electroconductive paste is spread in a thin layer on the specimen stub (15 mm×6 mm aluminum specimen stub) and the thoroughly pulverized observation sample A or B is placed thereon. Blowing with air is additionally performed to remove excess inorganic fine particles from the specimen stub and carry out thorough drying. The specimen stub is set in the specimen holder and the specimen stub height is adjusted to 36 mm with the specimen height gauge.

(2) Setting the Conditions for Observation with the S-4800

Calculation of the number-average particle diameter of the primary particles of the first and second inorganic fine particles is carried out using the images obtained by back-scattered electron image observation with the S-4800. The particle diameter can be measured with excellent accuracy using the backscattered electron image because charge up is less than for the secondary electron image.

Liquid nitrogen is introduced to the brim of the anti-contamination trap attached to the S-4800 housing and standing for 30 minutes is carried out. The "PCSTEM" of the S-4800 is started and flashing is performed (the FE tip, which is the electron source, is cleaned). The acceleration voltage display area in the control panel on the screen is clicked and the [flashing] button is pressed to open the flashing execution dialog. A flashing intensity of 2 is confirmed and execution is carried out. The emission current due to flashing is confirmed to be 20 to 40 μA. The specimen holder is inserted in the specimen chamber of the S-4800 housing. [home] is pressed on the control panel to transfer the specimen holder to the observation position.

The acceleration voltage display area is clicked to open the HV setting dialog and the acceleration voltage is set to [0.8 kV] and the emission current is set to [20 μA]. In the [base] tab of the operation panel, signal selection is set to [SE]; [upper(U)] and [+BSE] are selected for the SE detector; and [L.A. 100] is selected in the selection box to the right of [+BSE] to go into the observation mode using the backscattered electron image. Similarly, in the [base] tab of the operation panel, the probe current of the electron optical system condition block is set to [Normal]; the focus mode is set to [UHR]; and WD is set to [3.0 mm]. The [ON] button in the acceleration voltage display area of the control panel is pushed to apply the acceleration voltage.

(3) Calculation of the Number-Average Particle Diameter (D1) of the Primary Particles of the First and Second Inorganic Fine Particles The magnification is set to 100000× (100 k) by dragging within the magnification indicator area of the control panel. The [COARSE] focus knob on the operation panel is turned and adjustment of the aperture alignment is performed when some degree of focus has been obtained. [Align] is clicked in the control panel and the alignment dialog is displayed and [beam] is selected. The displayed beam is migrated to the center of the concentric circles by turning the STIGMA/ALIGNMENT knobs (X, Y) on the operation panel. [aperture] is then selected and the STIGMA/ALIGNMENT knobs (X, Y) are turned one at a time to adjust so as to stop the motion of the image or minimize the motion. The aperture dialog is closed and focusing is done with the autofocus. This operation is repeated an additional two times to achieve focus.

After this, the average particle diameter is determined by measuring the particle diameter for at least 300 inorganic fine particles. Here, since inorganic fine particles may also be present as aggregates, the major diameter is determined on inorganic fine particles that can be confirmed to be primary particles, and the number-average particle diameter (D1) of the primary particles of the first and second inorganic fine particles is obtained by taking the arithmetic average of the obtained major diameters. In addition, when, for example, the inorganic fine particles are silica fine particles and an object cannot be determined by its appearance to be a silica fine particle, elemental analysis may be carried out as appropriate and the particle diameter is then measured while confirming the detection of silicon as a major component.

<The Method for Measuring the Number-Average Particle Diameter (D1) of the Primary Particles of the Third Inorganic Fine Particles>

A sample B is prepared by carrying out detachment of the first and second inorganic fine particles from the magnetic toner, filtration, and drying using the same procedure as in (3) of "Methods for measuring the amounts of first and second inorganic fine particles".

Tetrahydrofuran is added to sample B with thorough mixing, followed by ultrasound dispersion for 10 minutes. The magnetic particles are attracted with a magnet and the supernatant is discarded. This procedure is carried out 5 times to obtain a sample C. Using this procedure, the organic component, e.g., the resin outside the magnetic body, can be almost completely removed. However, since tetrahydrofuran-insoluble matter in the resin may remain present, the residual organic component is combusted by heating the sample C yielded by the preceding procedure to 800° C., thus yielding a sample D. Sample D is observed using the S-4800 by proceeding in the same manner as in (1-3) to (3) of "The method for measuring the number-average particle diameter (D1) of the primary particles of the first and second inorganic fine particles". Sample D contains the magnetic body and the inorganic fine particles that were strongly fixed to the magnetic toner particle. Due to this, the particle diameter is measured on at least 300 inorganic fine particles while checking that they are the inorganic fine particles targeted for measurement by carrying out elemental analysis as appropriate, and the average particle diameter is then determined. Here, since inorganic fine particles may also be present as aggregates, the major diameter is determined on inorganic fine particles that can be confirmed to be primary particles, and the number-average particle diameter (D1) of the primary particles of the third inorganic fine particles is obtained by taking the arithmetic average of the obtained major diameters.

<The Weight-Average Particle Diameter (D4) and the Particle Size Distribution of the Magnetic Toner>

The weight-average particle diameter (D4) of the magnetic toner is determined proceeding as follows. The measurement instrument used is a "Coulter Counter Multisizer 3" (registered trademark, from Beckman Coulter, Inc.), a precision particle size distribution measurement instrument operating on the pore electrical resistance principle and equipped with a 100 μm aperture tube. The measurement conditions are set and the measurement data are analyzed using the accompanying dedicated software, i.e., "Beckman Coulter Multisizer 3 Version 3.51" (from Beckman Coulter, Inc.). The measurements are carried at 25,000 channels for the number of effective measurement channels.

The aqueous electrolyte solution used for the measurements is prepared by dissolving special-grade sodium chloride in ion-exchanged water to provide a concentration of about 1 mass % and, for example, "ISOTON II" (from Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (from Beckman Coulter, Inc.). The threshold value and noise level are automatically set by pressing the "threshold value/noise level measurement button". In addition, the current is set to 1600 μA; the gain is set to 2; the electrolyte is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) Approximately 200 mL of the above-described aqueous electrolyte solution is introduced into a 250-mL round-bottom glass beaker intended for use with the Multisizer 3 and this is placed in the sample stand and counterclockwise stirring with the stirrer rod is carried out at 24 rotations per second. Contamination and air bubbles within the aperture tube have previously been removed by the "aperture flush" function of the dedicated software.

(2) Approximately 30 mL of the above-described aqueous electrolyte solution is introduced into a 100-mL flatbottom glass beaker. To this is added as dispersant about 0.3 mL of a dilution prepared by the approximately three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System Tetora 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. Approximately 3.3 L of ion-exchanged water is introduced into the water tank of this ultrasound disperser and approximately 2 mL of Contaminon N is added to the water tank.

(4) The beaker described in (2) is set into the beaker holder opening on the ultrasound disperser and the ultrasound disperser is started. The height of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the magnetic toner is added to the aqueous electrolyte solution in small aliquots and dispersion is carried out. The ultrasound dispersion treatment is continued for an additional 60 seconds. The water temperature in the water tank is controlled as appropriate during ultrasound dispersion to be at least 10° C. and not more than 40° C.

(6) Using a pipette, the dispersed magnetic toner-containing aqueous electrolyte solution prepared in (5) is dripped into the roundbottom beaker set in the sample stand as described in (1) with adjustment to provide a measurement concentration of about 5%. Measurement is then performed until the number of measured particles reaches 50,000.

(7) The measurement data is analyzed by the previously cited software provided with the instrument and the weight-average particle diameter (D4) is calculated. When set to graph/volume % with the software, the "average diameter" on the "analysis/volumetric statistical value (arithmetic average)" screen is the weight-average particle diameter (D4).

<Method of Measuring the Average Circularity of the Magnetic Toner>

The average circularity of the magnetic toner is measured with the "FPIA-3000" (Sysmex Corporation), a flow-type particle image analyzer, using the measurement and analysis conditions from the calibration process.

The specific measurement method is as follows. First, approximately 20 mL of ion-exchanged water from which the solid impurities and so forth have previously been removed is placed in a glass container. To this is added as dispersant about 0.2 mL of a dilution prepared by the approximately three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.). Approximately 0.02 g of the measurement sample is also added and a dispersion treatment is carried out for 2 minutes using an ultrasound disperser to provide a dispersion for submission to measurement. Cooling is carried out as appropriate during this treatment so as to provide a dispersion temperature of at least 10° C. and no more than 40° C. The ultrasound disperser used here is a benchtop ultrasonic cleaner/disperser that has an oscillation frequency of 50 kHz and an electrical output of 150 W (for example, a "VS-150" from Velvo-Clear Co., Ltd.); a prescribed amount of ion-exchanged water is introduced into the water tank and approximately 2 mL of the aforementioned Contaminon N is also added to the water tank.

The previously cited flow-type particle image analyzer (fitted with a standard objective lens (10×)) is used for the measurement, and Particle Sheath "PSE-900A" (Sysmex Corporation) is used for the sheath solution. The dispersion prepared according to the procedure described above is introduced into the flow-type particle image analyzer and 3,000 of the magnetic toner are measured according to total count mode in HPF measurement mode. The average circularity of the magnetic toner is determined with the binarization threshold value during particle analysis set at 85% and the analyzed particle diameter limited to a circle-equivalent diameter of from at least 1.985 μm to less than 39.69 μm.

For this measurement, automatic focal point adjustment is performed prior to the start of the measurement using reference latex particles (for example, a dilution with ion-exchanged water of "RESEARCH AND TEST PARTICLES Latex Microsphere Suspensions 5200A" from Duke Scientific). After this, focal point adjustment is preferably performed every two hours after the start of measurement.

In the present invention, the flow-type particle image analyzer used had been calibrated by the Sysmex Corporation and had been issued a calibration certificate by the Sysmex Corporation. The measurements are carried out under the same measurement and analysis conditions as when the calibration certificate was received, with the exception that the analyzed particle diameter is limited to a circle-equivalent diameter of from at least 1.985 μm to less than 39.69 μm.

The "FPIA-3000" flow-type particle image analyzer (Sysmex Corporation) uses a measurement principle based on taking a still image of the flowing particles and performing image analysis. The sample added to the sample chamber is delivered by a sample suction syringe into a flat sheath flow cell. The sample delivered into the flat sheath flow is sandwiched by the sheath liquid to form a flat flow. The sample passing through the flat sheath flow cell is exposed to stroboscopic light at an interval of 1/60 second, thus enabling a still image of the flowing particles to be photographed. Moreover, since flat flow is occurring, the photograph is taken under in-focus conditions. The particle image is photographed with a CCD camera; the photographed image is subjected to image processing at an image processing resolution of 512×512 (0.37 μm×0.37 μm per pixel); contour definition is performed on each particle image; and, among other things, the projected area S and the periphery length L are measured on the particle image.

The circle-equivalent diameter and the circularity are then determined using this area S and periphery length L. The circle-equivalent diameter is the diameter of the circle that has the same area as the projected area of the particle image, and the circularity is defined as the value provided by dividing the circumference of the circle determined from the circle-equivalent diameter by the periphery length of the particle's projected image and is calculated using the following formula.

$$\text{circularity}=2\times(\pi\times S)^{1/2}/L$$

The circularity is 1.000 when the particle image is a circle, and the value of the circularity declines as the degree of unevenness in the periphery of the particle image increases. After the circularity of each particle has been calculated, 800 are fractionated out in the circularity range of 0.200 to 1.000; the arithmetic average value of the obtained circularities is calculated; and this value is used as the average circularity.

<Method for Measuring the Acid Value of the Magnetic Toner and Binder Resin>

The acid value is determined in the present invention using the following procedure. The basic procedure falls under JIS K 0070.

The measurement is carried out using a potentiometric titration apparatus for the measurement instrumentation. An automatic titration can be used for this titration using an AT-400 (winworkstation) potentiometric titration apparatus and ABP-410 piston burette from Kyoto Electronics Manufacturing Co., Ltd.

The instrument is calibrated using a mixed solvent of 120 mL toluene and 30 mL ethanol. 25° C. is used for the measurement temperature.

The sample is prepared by introducing 1.0 g of the magnetic toner or 0.5 g of the binder resin into a mixed solvent of 120 mL toluene and 30 mL ethanol followed by dispersion for 10 minutes by ultrasound dispersion. After this, a magnetic stirrer is introduced and stirring and dissolution are carried out for about 10 hours while covered. A blank test is performed using an ethanol solution of 0.1 mol/L potassium hydroxide. The amount of the ethanolic potassium hydroxide solution used here is designated B (mL). For the above-described sample solution that has been stirred for 10 hours, the magnetic body is magnetically separated and the soluble fraction (the test solution from the magnetic toner or the binder resin) is titrated. The amount of potassium hydroxide solution used here is designated S (mL). The acid value is calculated with the following formula. The f in this formula is a factor for the KOH.

$$\text{acid value(mg KOH/g)}=\{(S-B)\times f\times 5.61\}/W$$

<Method for Measuring the Peak Molecular Weight of the Binder Resin>

The peak molecular weight of the binder resin is measured using gel permeation chromatography (GPC) under the following conditions.

The column is stabilized in a heated chamber at 40° C., and tetrahydrofuran (THF) is introduced as solvent at a flow rate of 1 mL per minute into the column at this temperature. For the column, a combination of a plurality of commercially available polystyrene gel columns is favorably used in order to accurately measure the molecular weight range of $1\times10^3$ to $2\times10^6$. Examples here are the combination of Shodex GPC KF-801, 802, 803, 804, 805, 806, 807, and 800P from Showa Denko Kabushiki Kaisha and the combination of TSKgel G1000H($H_{XL}$), G2000H($H_{XL}$), G3000H ($H_{XL}$), G4000H ($H_{XL}$), G5000H ($H_{XL}$), G6000H ($H_{XL}$), G7000H($H_{XL}$), and TSKguard column from Tosoh Corporation, while a 7-column train of Shodex KF-801, 802, 803, 804, 805, 806, and 807 from Showa Denko Kabushiki Kaisha is preferred in particular.

On the other hand, the binder resin is dispersed and dissolved in THF and allowed to stand overnight and is then filtered on a sample treatment filter (for example, a MyShoriDisk H-25-2 with a pore size of 0.2 to 0.5 μm (Tosoh Corporation)) and the filtrate is used for the sample. 50 to 200 μL of the THF solution of the binder resin, which has been adjusted to bring the binder resin component to 0.5 to 5 mg/mL for the sample concentration, is injected to carry out the measurement. An RI (refractive index) detector is used for the detector.

To measure the molecular weight of the sample, the molecular weight distribution possessed by the sample is calculated from the relationship between the number of counts and the logarithmic value on a calibration curve constructed using several different monodisperse polystyrene standard samples. The standard polystyrene samples used to construct the calibration curve can be exemplified by samples with a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ from the Pressure Chemical Company or Tosoh Corporation, and standard polystyrene samples at approximately 10 points or more are suitably used.

<Method for Measuring the Dielectric Constant ε' and Dielectric Loss Tangent (Tan δ) of the Magnetic Toners>

The dielectric characteristics of the magnetic toners are measured using the following method.

1 g of the magnetic toner is weighed out and subjected to a load of 20 kPa for 1 minute to mold a disk-shaped measurement specimen having a diameter of 25 mm and a thickness of 1.5±0.5 mm.

This measurement specimen is mounted in an ARES (TA Instruments, Inc.) that is equipped with a dielectric constant measurement tool (electrodes) that has a diameter of 25 mm. While a load of 250 g/cm$^2$ is being applied at the measurement temperature of 30° C., the complex dielectric constant at 100 kHz and a temperature of 30° C. is measured using a 4284A Precision LCR meter (Hewlett-Packard Company) and the dielectric constant C and the dielectric loss tangent (tan δ) are calculated from the value measured for the complex dielectric constant.

EXAMPLES

The present invention is described in additional detail through the examples and comparative examples provided below, but the present invention is in no way restricted to or by these. The % and number of parts in the examples and comparative examples, unless specifically indicated otherwise, are in all instances on a mass basis.

Binder Resin Production Examples

Binder Resin Production Example 1

The molar ratio for the polyester monomers is as follows. BPA-PO/BPA-EO/TPA/TMA=50/50/70/12

Here, BPA-PO refers to the 2.2 mole adduct of propylene oxide on bisphenol A; BPA-EO refers to the 2.2 mole adduct of ethylene oxide on bisphenol A; TPA refers to terephthalic acid; and TMA refers to trimellitic anhydride.

Of the starting monomers shown above, the starting monomers other than the TMA and 0.1 mass % tetrabutyl titanate as catalyst were introduced into a flask equipped with a water removal tube, stirring blade, nitrogen inlet tube, and so forth. After carrying out a condensation polymerization for 10 hours at 220° C., the TMA was added and a reaction was carried out at 210° C. until the desired acid value was reached to yield a polyester resin 1 (glass transition temperature Tg=64° C., acid value=17 mg KOH/g, and peak molecular weight=6200).

Binder Resin Production Examples 2 to 5

The peak molecular weight, Tg, and acid value were appropriately adjusted by changing the starting monomer ratio of Binder Resin Production Example 1 as shown below to obtain the binder resins 2 to 5 shown in Table 1.

binder resin 2: BPA-PO/BPA-EO/TPA/TMA=50/50/80/10
binder resin 3: BPA-PO/BPA-EO/TPA/TMA=60/40/70/20
binder resin 4: BPA-PO/BPA-EO/TPA/TMA=50/50/70/10
binder resin 5: BPA-PO/BPA-EO/TPA/TMA=50/50/70/15

Binder Resin Production Example 6

300 mass parts of xylene was introduced into a four-neck flask and was heated under reflux and a mixture of 78 mass parts of styrene, 22 mass parts of n-butyl acrylate, and 3.0 mass parts of di-tert-butyl peroxide was added dropwise over 5 hours to obtain a low molecular weight polymer (L-1) solution.

180 mass parts of degassed water and 20 mass parts of a 2 mass % aqueous polyvinyl alcohol solution were introduced into a four-neck flask; a liquid mixture of 78 mass parts of styrene, 22 mass parts of n-butyl acrylate, 0.005 mass parts of divinylbenzene, and 0.09 mass parts of 2,2-bis(4,4-di-tert-butylperoxycyclohexyl)propane (10-hour half-life temperature: 92° C.) was thereafter added; and stirring was carried out to yield a suspension. After the interior of the flask had been thoroughly replaced with nitrogen, the temperature was raised to 85° C. and polymerization was carried out; after holding for 24 hours, a supplemental addition of 0.1 mass parts of benzoyl peroxide (10-hour half-life temperature: 72° C.) was made and holding was continued for another 12 hours to finish the polymerization of a high molecular weight polymer (H-1).

25 mass parts of the high molecular weight polymer (H-1) was introduced into 300 mass parts of the homogeneous low molecular weight polymer (L-1) solution and thorough mixing was carried out under reflux. This was followed by the distillative removal of the organic solvent to yield the binder resin 6 (glass transition temperature Tg=58° C., acid value=0 mg KOH/g, peak molecular weight=6500) shown in Table 1, which was a styrene-acrylic resin.

TABLE 1

List of binder resins

| | resin type | peak molecular weight | Tg (° C.) | acid value (mgKOH/g) |
|---|---|---|---|---|
| binder resin 1 | polyester resin | 6200 | 64 | 17 |
| binder resin 2 | polyester resin | 6500 | 65 | 8 |
| binder resin 3 | polyester resin | 6100 | 64 | 45 |
| binder resin 4 | polyester resin | 6300 | 64 | 12 |
| binder resin 5 | polyester resin | 6200 | 63 | 39 |
| binder resin 6 | styrene-acrylic resin | 6500 | 58 | 0 |

Magnetic Body 1 Production Example

An aqueous solution containing ferrous hydroxide was prepared by mixing the following in an aqueous solution of ferrous sulfate: a sodium hydroxide solution at 1.1 mol-equivalent with reference to the iron, $SiO_2$ in an amount that provided 0.60 mass % as silicon with reference to the iron, and sodium phosphate in an amount that provided 0.15 mass % as phosphorus with reference to the iron. The pH of the aqueous solution was brought to 8.0 and an oxidation reaction was run at 85° C. while blowing in air to prepare a slurry containing seed crystals.

An aqueous ferrous sulfate solution was then added to provide 1.0 equivalent with reference to the amount of the starting alkali (sodium component in the sodium hydroxide) in this slurry and an oxidation reaction was subsequently run while blowing in air and maintaining the slurry at pH 7.5 to obtain a slurry containing magnetic iron oxide. This slurry was filtered, washed, dried, and ground to obtain a magnetic body 1 that had a volume-average particle diameter (Dv) of 0.21 μm and a saturation magnetization of 66.7 $Am^2/kg$ and residual magnetization of 4.0 $Am^2/kg$ for a magnetic field of 79.6 kA/m (1000 oersted).

Magnetic Body 2 Production Example

An aqueous solution containing ferrous hydroxide was prepared by mixing the following in an aqueous solution of ferrous sulfate: a sodium hydroxide solution at 1.1 mol-equivalent with reference to the iron and $SiO_2$ in an amount that provided 0.60 mass % as silicon with reference to the iron. The pH of the aqueous solution was brought to 8.0 and an oxidation reaction was run at 85° C. while blowing in air to prepare a slurry containing seed crystals.

An aqueous ferrous sulfate solution was then added to provide 1.0 equivalent with reference to the amount of the starting alkali (sodium component in the sodium hydroxide) in this slurry and an oxidation reaction was subsequently run while blowing in air and maintaining the slurry at pH 8.5 to obtain a slurry containing magnetic iron oxide. This slurry was filtered, washed, dried, and ground to obtain a magnetic body 2 that had a volume-average particle diameter (Dv) of 0.22 μm and a saturation magnetization of 66.1 $Am^2/kg$ and residual magnetization of 5.9 $Am^2/kg$ for a magnetic field of 79.6 kA/m (1000 oersted).

Magnetic Body 3 Production Example

An aqueous solution containing ferrous hydroxide was prepared by mixing the following in an aqueous solution of ferrous sulfate: a sodium hydroxide solution at 1.1 mol-equivalent with reference to the iron. The pH of the aqueous solution was brought to 8.0 and an oxidation reaction was run at 85° C. while blowing in air to prepare a slurry containing seed crystals. An aqueous ferrous sulfate solution was then added to provide 1.0 equivalent with reference to the amount of the starting alkali (sodium component in the sodium hydroxide) in this slurry and an oxidation reaction was run while blowing in air and maintaining the slurry at pH 12.8 to obtain a slurry containing magnetic iron oxide. This slurry was filtered, washed, dried, and ground to obtain a magnetic body 3 that had a volume-average particle diameter (Dv) of 0.20 μm and a saturation magnetization of 65.9 $Am^2/kg$ and residual magnetization of 7.3 $Am^2/kg$ for a magnetic field of 79.6 kA/m (1000 oersted).

Silica Fine Particle Production Example 1

A suspension of silica fine particles was obtained by the dropwise addition of tetramethoxysilane in the presence of methanol, water, and aqueous ammonia while stirring and heating to 35° C. The surface of the silica fine particles was subjected to a hydrophobic treatment by solvent substitution, the addition at room temperature to the obtained dispersion of hexamethyldisilazane as hydrophobing agent, and thereafter heating to 130° C. and carrying out a reaction. The coarse particles were removed by wet passage through a sieve followed by removal of the solvent and drying to obtain silica fine particle 1 (sol-gel silica). Silica fine particle 1 is shown in Table 2.

Silica Fine Particle Production Examples 2 to 4

Silica fine particles 2 to 4 were obtained proceeding as in Silica Fine Particle Production Example 1, but changing the reaction temperature and stirring rate as appropriate. Silica fine particles 2 to 4 are shown in Table 2.

Silica Fine Particle Production Example 5

100 mass parts of a dry silica (BET: 50 $m^2/g$) was treated with 15 mass parts of hexamethyldisilazane and then with 10 mass parts of dimethylsilicone oil to obtain silica fine particle 5. Silica fine particle 5 is shown in Table 2.

Silica Fine Particle Production Examples 6 to 8

Silica fine particles 6 to 8 were obtained in the same manner by carrying out the same surface treatment as for silica fine particle 5, but using starting silica fine particles as indicated below, which had different BET values for the dry silica. Silica fine particles 6 to 8 are shown in Table 2.
silica fine particle 6: BET: 200 $m^2/g$
silica fine particle 7: BET: 300 $m^2/g$
silica fine particle 8: BET: 130 $m^2/g$

TABLE 2

List of silica fine particles

| | number-average particle diameter D1 of the primary particles (nm) | type of silica |
|---|---|---|
| silica fine particle 1 | 110 | sol-gel silica |
| silica fine particle 2 | 170 | sol-gel silica |
| silica fine particle 3 | 190 | sol-gel silica |
| silica fine particle 4 | 55 | sol-gel silica |
| silica fine particle 5 | 30 | fumed silica |
| silica fine particle 6 | 11 | fumed silica |
| silica fine particle 7 | 7 | fumed silica |
| silica fine particle 8 | 13 | fumed silica |

Magnetic Toner Particle Production Example 1

| | |
|---|---|
| binder resin 1: | 100 mass parts |
| wax 1 as shown in Table 3: | 5.0 mass parts |
| magnetic body 1: | 95 mass parts |
| T-77 charge control agent (Hodogaya Chemical Co., Ltd.): | 1.0 mass parts |

TABLE 3

List of waxes

| | name | maximum endothermic peak temperature (° C.) |
|---|---|---|
| wax 1 | behenyl behenate | 73.2 |
| wax 2 | palmityl palmitate | 55.2 |
| wax 3 | stearyl stearate | 68.1 |
| wax 4 | lignoceryl lignocerate | 78.5 |

TABLE 3-continued

List of waxes

| | name | maximum endothermic peak temperature (° C.) |
|---|---|---|
| wax 5 | myristyl myristate | 44.6 |
| wax 6 | glycerol tribehenate | 68.5 |
| wax 7 | paraffin wax | 75.2 |
| wax 8 | carnauba wax | 83.6 |

The raw materials listed above were preliminarily mixed using an FM10C Henschel mixer (Mitsui Miike Chemical Engineering Machinery Co., Ltd.) and were then kneaded with a twin-screw kneader/extruder (PCM-30, Ikegai Ironworks Corporation) set at a rotation rate of 200 rpm with the set temperature being adjusted to provide a direct temperature in the vicinity of the outlet for the kneaded material of 155° C.

The resulting melt-kneaded material was cooled; the cooled melt-kneaded material was coarsely pulverized with a cutter mill; the resulting coarsely pulverized material was finely pulverized using a Turbo Mill T-250 (Turbo Kogyo Co., Ltd.) at a feed rate of 20 kg/hr with the air temperature adjusted to provide an exhaust temperature of 40° C.; and classification was performed using a Coanda effect-based multi-grade classifier to obtain a magnetic toner particle having a weight-average particle diameter (D4) of 7.9 μm.

An external addition and mixing process was carried out using the apparatus shown in FIG. 2 on the magnetic toner particle obtained as described above. In this example an apparatus (NOB-130, Hosokawa Micron Corporation) was used that had a volume for the processing space 9 of the apparatus shown in FIG. 2 of $2.0\times10^{-3}$ $m^3$, and the rated power for the drive member 8 was 5.5 kW and the stirring member 3 had the shape given in FIG. 3. The overlap width d in FIG. 3 between the stirring member 3*a* and the stirring member 3*b* was 0.25 D with respect to the maximum width D of the stirring member 3, and the minimum gap between the stirring member 3 and the inner circumference of the main casing 1 was 2.0 mm.

100 mass parts (500 g) of the aforementioned magnetic toner particle and 3.0 mass parts of the silica fine particle 1 referenced in Table 2 were introduced into the apparatus shown in FIG. 2 having the apparatus structure described above.

A pre-mixing was carried out after the introduction of the magnetic toner particles and the silica fine particles in order to uniformly mix the magnetic toner particles and the silica fine particles. The pre-mixing conditions were as follows: a drive member 8 power of 0.1 W/g (drive member 8 rotation rate of 150 rpm) and a processing time of 1 minute.

The external addition and mixing process was carried out once pre-mixing was finished. With regard to the conditions for the external addition and mixing process, the processing time was 5 minutes and the peripheral velocity of the outermost end of the stirring member 3 was adjusted to provide a constant drive member 8 power of 1.6 W/g (drive member 8 rotation rate of 2500 rpm).

A surface modification with the surface modification apparatus shown in FIG. 1 was then run on the magnetic toner particles that had been subjected to the external addition and mixing process with silica fine particle 1. The conditions in all of the surface modifications were as follows: raw material feed rate, all at 2 kg/hr; hot air current flow rate, all at 7 $m^3$/min; and hot air current ejection temperature, all at 300° C. The following were also used: cold air current temperature=4° C., cold air current flow rate=4 $m^3$/min, blower air flow rate=20 $m^3$/min, and injection air flow rate=1 $m^3$/min. This surface modification process yielded a magnetic toner particle 1 that had strongly fixed silica fine particles (third inorganic fine particles) at the surface.

The formulation and surface modification conditions for magnetic toner particle 1 are given in Table 4.

Magnetic Toner Particle Production Examples 2 to 28

Magnetic toner particles 2 to 28 were obtained proceeding as in Magnetic Toner Particle Production Example 1, but changing the magnetic toner formulation, type of silica added before surface modification, amount of its addition, and temperature during surface modification of Magnetic Toner Particle Production Example 1 as shown in Table 4.

The formulation and surface modification conditions for magnetic toner particles 2 to 28 are given in Table 4.

TABLE 4

Formulations and surface modification conditions for the magnetic toner particles

| | | magnetic body | | | weight-average | silica fine particle added prior to surface modification | | surface modifi- |
|---|---|---|---|---|---|---|---|---|
| | binder resin | type of magnetic body | content (mass parts) | type of wax | particle diameter D4(μm) | type of silica fine particle | amount of addition (mass parts) | cation temper-ature (° C.) |
| magnetic toner particle 1 | binder resin 1 | magnetic body 1 | 95 | wax 1 | 7.9 | silica fine particle 1 | 3.0 | 300 |
| magnetic toner particle 2 | binder resin 1 | magnetic body 1 | 95 | wax 1 | 8.0 | silica fine particle 1 | 4.0 | 300 |
| magnetic toner particle 3 | binder resin 1 | magnetic body 1 | 95 | wax 1 | 8.1 | silica fine particle 1 | 2.5 | 300 |
| magnetic toner particle 4 | binder resin 1 | magnetic body 2 | 95 | wax 1 | 8.0 | silica fine particle 1 | 3.0 | 300 |
| magnetic toner particle 5 | binder resin 1 | magnetic body 3 | 95 | wax 1 | 8.2 | silica fine particle 1 | 3.0 | 300 |
| magnetic toner particle 6 | binder resin 1 | magnetic body 3 | 95 | wax 2 | 7.9 | silica fine particle 1 | 3.0 | 300 |
| magnetic toner particle 7 | binder resin 1 | magnetic body 3 | 95 | wax 3 | 8.0 | silica fine particle 1 | 3.0 | 300 |
| magnetic toner particle 8 | binder resin 1 | magnetic body 3 | 95 | wax 4 | 7.8 | silica fine particle 1 | 3.0 | 300 |
| magnetic toner particle 9 | binder resin 1 | magnetic body 3 | 95 | wax 5 | 7.9 | silica fine particle 1 | 3.0 | 300 |
| magnetic toner particle 10 | binder resin 1 | magnetic body 3 | 95 | wax 6 | 8.1 | silica fine particle 1 | 3.0 | 300 |
| magnetic toner particle 11 | binder resin 1 | magnetic body 3 | 95 | wax 7 | 8.2 | silica fine particle 1 | 3.0 | 300 |
| magnetic toner particle 12 | binder resin 1 | magnetic body 3 | 95 | wax 8 | 8.2 | silica fine particle 1 | 3.0 | 300 |
| magnetic toner particle 13 | binder resin 2 | magnetic body 3 | 95 | wax 8 | 8.1 | silica fine particle 1 | 3.0 | 300 |
| magnetic toner particle 14 | binder resin 3 | magnetic body 3 | 95 | wax 8 | 8.0 | silica fine particle 1 | 3.0 | 300 |
| magnetic toner particle 15 | binder resin 4 | magnetic body 3 | 95 | wax 8 | 8.0 | silica fine particle 1 | 3.0 | 300 |
| magnetic toner particle 16 | binder resin 5 | magnetic body 3 | 95 | wax 8 | 7.9 | silica fine particle 1 | 3.0 | 300 |
| magnetic toner particle 17 | binder resin 3 | magnetic body 3 | 95 | wax 8 | 8.1 | silica fine particle 1 | 3.2 | 150 |
| magnetic toner particle 18 | binder resin 3 | magnetic body 3 | 60 | wax 8 | 8.2 | silica fine particle 1 | 3.2 | 150 |
| magnetic toner particle 19 | binder resin 3 | magnetic body 3 | 105 | wax 8 | 8.1 | silica fine particle 1 | 3.2 | 150 |
| magnetic toner particle 20 | binder resin 6 | magnetic body 3 | 95 | wax 8 | 7.9 | silica fine particle 1 | 3.2 | 150 |
| magnetic toner particle 21 | binder resin 3 | magnetic body 3 | 120 | wax 8 | 8.2 | silica fine particle 1 | 3.2 | 150 |
| magnetic toner particle 22 | binder resin 1 | magnetic body 3 | 95 | wax 8 | 8.1 | silica fine particle 2 | 3.0 | 300 |
| magnetic toner particle 23 | binder resin 1 | magnetic body 3 | 95 | wax 8 | 7.9 | silica fine particle 3 | 3.0 | 300 |
| magnetic toner particle 24 | binder resin 1 | magnetic body 3 | 95 | wax 8 | 8.0 | silica fine particle 4 | 3.0 | 300 |
| magnetic toner particle 25 | binder resin 1 | magnetic body 3 | 95 | wax 8 | 7.8 | silica fine particle 5 | 3.0 | 300 |
| magnetic toner particle 26 | binder resin 1 | magnetic body 3 | 95 | wax 1 | 8.1 | silica fine particle 1 | 1.0 | 300 |
| magnetic toner particle 27 | binder resin 1 | magnetic body 3 | 95 | wax 1 | 8.2 | silica fine particle 1 | 5.0 | 300 |
| magnetic toner particle 28 | binder resin 1 | magnetic body 3 | 95 | wax 1 | 8.1 | — | — | 300 |

Magnetic Toner Production Example 1

The magnetic toner particle 1 obtained in Magnetic Toner Particle Production Example 1 was subjected to an external addition and mixing process using the apparatus shown in FIG. 2 having the same structure as used in Magnetic Toner Particle Production Example 1.

100 mass parts of magnetic toner particle 1 and 0.50 mass parts of the silica fine particle 6 referenced in Table 3 were introduced into the apparatus shown in FIG. 2.

A pre-mixing was carried out after the introduction of the magnetic toner particles and the silica fine particles in order to uniformly mix the magnetic toner particles and the silica fine particles. The pre-mixing conditions were as follows: a drive member 8 power of 0.10 W/g (drive member 8 rotation rate of 150 rpm) and a processing time of 1 minute.

The external addition and mixing process was carried out once pre-mixing was finished. With regard to the conditions for the external addition and mixing process, the processing time was 5 minutes and the peripheral velocity of the outermost end of the stirring member 3 was adjusted to provide a constant drive member 8 power of 0.60 W/g (drive member 8 rotation rate of 1400 rpm).

Subsequent to this, an additional 0.30 mass parts of silica fine particle 6 (a total of 0.80 mass parts into the magnetic toner particles) was added and 0.2 mass parts of titania fine particles (titania fine particles with a specific surface area measured by the BET method (BET specific surface area) of 130 $m^2$/g, which had been subjected to a hydrophobic treatment with hexamethyldisilazane) was also added, and an additional treatment was performed for 2 minutes with adjustment of the peripheral velocity of the outermost end of the stirring member 3 so as to provide a constant drive member 8 power of 0.60 W/g (drive member 8 rotation rate of 1400 rpm).

After the external addition and mixing process, the coarse particles and so forth were removed using a circular vibrating screen equipped with a screen having a diameter of 500 mm and an aperture of 75 μm to obtain magnetic toner 1.

The external addition and mixing process conditions for magnetic toner 1 are shown in Table 5.

Table 6 reports the results of the measurements on magnetic toner 1, using the previously described methods, for the amount of weakly fixed silica fine particles (first inorganic fine particles), the amount of medium-fixed silica fine particles (second inorganic fine particles), the coverage ratio X by the strongly fixed silica fine particles (third inorganic fine particles), the dielectric and magnetic properties, and the maximum endothermic peak temperature.

TABLE 5

External addition and mixing process conditions for the magnetic toners

| magnetic toner | magnetic toner particle | first-stage external addition conditions: amount of silica fine particle addition (mass parts) | first-stage external addition conditions: first-stage external addition conditions | second-stage external addition conditions: amount of silica fine particle addition (mass parts) | second-stage external addition conditions: amount of titania fine particle addition (mass parts) | second-stage external addition conditions: second-stage external addition conditions |
|---|---|---|---|---|---|---|
| magnetic toner 1 | magnetic toner particle 1 | silica fine particle 6 (0.5) | 0.60 W/g (1400 rpm) - 5 min | silica fine particle 6 (0.3) | titania fine particles (0.2) | 0.60 W/g (1400 rpm) - 3 min |
| magnetic toner 2 | magnetic toner particle 1 | silica fine particle 6 (0.6) | 0.60 W/g (1400 rpm) - 5 min | silica fine particle 6 (0.2) | titania fine particles (0.2) | 0.60 W/g (1400 rpm) - 5 min |
| magnetic toner 3 | magnetic toner particle 1 | silica fine particle 6 (0.4) | 0.60 W/g (1400 rpm) - 5 min | silica fine particle 6 (0.2) | titania fine particles (0.2) | 0.60 W/g (1400 rpm) - 3 min |
| magnetic toner 4 | magnetic toner particle 1 | silica fine particle 6 (0.8) | 0.60 W/g (1400 rpm) - 5 min | silica fine particle 6 (0.7) | titania fine particles (0.2) | 0.60 W/g (1400 rpm) - 3 min |
| magnetic toner 5 | magnetic toner particle 1 | silica fine particle 6 (0.7) | 0.60 W/g (1400 rpm) - 5 min | silica fine particle 6 (0.3) | titania fine particles (0.2) | 0.60 W/g (1400 rpm) - 3 min |
| magnetic toner 6 | magnetic toner particle 2 | silica fine particle 6 (0.7) | 0.60 W/g (1400 rpm) - 5 min | silica fine particle 6 (0.2) | titania fine particles (0.2) | 0.60 W/g (1400 rpm) - 3 min |
| magnetic toner 7 | magnetic toner particle 3 | silica fine particle 6 (0.7) | 0.60 W/g (1400 rpm) - 5 min | silica fine particle 6 (0.3) | titania fine particles (0.2) | 0.60 W/g (1400 rpm) - 3 min |
| magnetic toner 8 | magnetic toner particle 1 | silica fine particle 6 (0.7) | 0.60 W/g (1400 rpm) - 5 min | silica fine particle 6 (0.3) | — | 0.60 W/g (1400 rpm) - 3 min |
| magnetic toner 9 | magnetic toner particle 4 | silica fine particle 6 (0.7) | 0.60 W/g (1400 rpm) - 5 min | silica fine particle 6 (0.3) | — | 0.60 W/g (1400 rpm) - 3 min |
| magnetic toner 10 | magnetic toner particle 5 | silica fine particle 6 (0.7) | 0.60 W/g (1400 rpm) - 5 min | silica fine particle 6 (0.3) | — | 0.60 W/g (1400 rpm) - 3 min |
| magnetic toner 11 | magnetic toner particle 6 | silica fine particle 6 (0.7) | 0.60 W/g (1400 rpm) - 5 min | silica fine particle 6 (0.3) | — | 0.60 W/g (1400 rpm) - 3 min |
| magnetic toner 12 | magnetic toner particle 7 | silica fine particle 6 (0.7) | 0.60 W/g (1400 rpm) - 5 min | silica fine particle 6 (0.3) | — | 0.60 W/g (1400 rpm) - 3 min |
| magnetic toner 13 | magnetic toner particle 8 | silica fine particle 6 (0.7) | 0.60 W/g (1400 rpm) - 5 min | silica fine particle 6 (0.3) | — | 0.60 W/g (1400 rpm) - 3 min |
| magnetic toner 14 | magnetic toner particle 9 | silica fine particle 6 (0.7) | 0.60 W/g (1400 rpm) - 5 min | silica fine particle 6 (0.3) | — | 0.60 W/g (1400 rpm) - 3 min |
| magnetic toner 15 | magnetic toner particle 10 | silica fine particle 6 (0.7) | 0.60 W/g (1400 rpm) - 5 min | silica fine particle 6 (0.3) | — | 0.60 W/g (1400 rpm) - 3 min |
| magnetic toner 16 | magnetic toner particle 11 | silica fine particle 6 (0.7) | 0.60 W/g (1400 rpm) - 5 min | silica fine particle 6 (0.3) | — | 0.60 W/g (1400 rpm) - 3 min |
| magnetic toner 17 | magnetic toner particle 12 | silica fine particle 6 (0.7) | 0.60 W/g (1400 rpm) - 5 min | silica fine particle 6 (0.3) | — | 0.60 W/g (1400 rpm) - 3 min |
| magnetic toner 18 | magnetic toner particle 13 | silica fine particle 6 (0.7) | 0.60 W/g (1400 rpm) - 5 min | silica fine particle 6 (0.3) | — | 0.60 W/g (1400 rpm) - 3 min |
| magnetic toner 19 | magnetic toner particle 14 | silica fine particle 6 (0.7) | 0.60 W/g (1400 rpm) - 5 min | silica fine particle 6 (0.3) | — | 0.60 W/g (1400 rpm) - 3 min |
| magnetic toner 20 | magnetic toner particle 15 | silica fine particle 6 (0.7) | 0.60 W/g (1400 rpm) - 5 min | silica fine particle 6 (0.3) | — | 0.60 W/g (1400 rpm) - 3 min |
| magnetic toner 21 | magnetic toner particle 16 | silica fine particle 6 (0.7) | 0.60 W/g (1400 rpm) - 5 min | silica fine particle 6 (0.3) | — | 0.60 W/g (1400 rpm) - 3 min |
| magnetic toner 22 | magnetic toner particle 17 | silica fine particle 6 (0.7) | 0.60 W/g (1400 rpm) - 5 min | silica fine particle 6 (0.3) | — | 0.60 W/g (1400 rpm) - 3 min |
| magnetic toner 23 | magnetic toner particle 18 | silica fine particle 6 (0.7) | 0.60 W/g (1400 rpm) - 5 min | silica fine particle 6 (0.3) | — | 0.60 W/g (1400 rpm) - 3 min |
| magnetic toner 24 | magnetic toner particle 19 | silica fine particle 6 (0.7) | 0.60 W/g (1400 rpm) - 5 min | silica fine particle 6 (0.3) | — | 0.60 W/g (1400 rpm) - 3 min |
| magnetic toner 25 | magnetic toner particle 20 | silica fine particle 6 (0.7) | 0.60 W/g (1400 rpm) - 5 min | silica fine particle 6 (0.3) | — | 0.60 W/g (1400 rpm) - 3 min |
| magnetic toner 26 | magnetic toner particle 21 | silica fine particle 6 (0.7) | 0.60 W/g (1400 rpm) - 5 min | silica fine particle 6 (0.3) | — | 0.60 W/g (1400 rpm) - 3 min |
| magnetic toner 27 | magnetic toner particle 22 | silica fine particle 7 (0.7) | 0.60 W/g (1400 rpm) - 5 min | silica fine particle 7 (0.3) | — | 0.60 W/g (1400 rpm) - 3 min |
| magnetic toner 28 | magnetic toner particle 23 | silica fine particle 6 (0.7) | 0.60 W/g (1400 rpm) - 5 min | silica fine particle 6 (0.3) | — | 0.60 W/g (1400 rpm) - 3 min |
| magnetic toner 29 | magnetic toner particle 1 | silica fine particle 5 (0.8) | 0.60 W/g (1400 rpm) - 8 min | silica fine particle 5 (0.2) | — | 0.60 W/g (1400 rpm) - 5 min |
| magnetic toner 30 | magnetic toner particle 24 | silica fine particle 8 (0.7) | 0.60 W/g (1400 rpm) - 5 min | silica fine particle 8 (0.3) | — | 0.60 W/g (1400 rpm) - 3 min |
| magnetic toner 31 | magnetic toner particle 25 | silica fine particle 6 (0.8) | 0.60 W/g (1400 rpm) - 5 min | silica fine particle 6 (0.2) | — | 0.60 W/g (1400 rpm) - 5 min |
| comparative magnetic toner 1 | magnetic toner particle 26 | silica fine particle 6 (0.7) | 0.60 W/g (1400 rpm) - 5 min | silica fine particle 6 (0.3) | — | 0.60 W/g (1400 rpm) - 3 min |
| comparative magnetic toner 2 | magnetic toner particle 27 | silica fine particle 6 (0.7) | 0.60 W/g (1400 rpm) - 5 min | silica fine particle 6 (0.3) | — | 0.60 W/g (1400 rpm) - 3 min |
| comparative magnetic toner 3 | magnetic toner particle 5 | silica fine particle 6 (1.2) | 1.60 W/g (2500 rpm) - 15 min | — | — | — |
| comparative magnetic toner 4 | magnetic toner particle 5 | silica fine particle 6 (0.6) | 1.60 W/g (2500 rpm) - 11 min | — | — | — |
| comparative magnetic toner 5 | magnetic toner particle 5 | silica fine particle 6 (0.5) | 0.60 W/g (1400 rpm) - 5 min | — | — | — |
| comparative magnetic toner 6 | magnetic toner particle 5 | silica fine particle 6 (2.4) | 1.60 W/g (2500 rpm) - 15 min | — | — | — |
| comparative magnetic toner 7 | magnetic toner particle 5 | silica fine particle 6 (2.4) | 1.60 W/g (2500 rpm) - 11 min | — | — | — |
| comparative magnetic toner 8 | magnetic toner particle 5 | silica fine particle 6 (1.0) | 0.60 W/g (1400 rpm) - 5 min | — | — | — |
| comparative magnetic toner 9 | magnetic toner particle 5 | silica fine particle 6 (1.2) | 0.60 W/g (1400 rpm) - 5 min | — | — | — |
| comparative magnetic toner 10 | magnetic toner particle 28 | silica fine particle 6 (1.0) | 3.30 W/g (4000 rpm) - 10 min | — | — | — |
| comparative magnetic toner 11 | magnetic toner particle 28 | silica fine particle 6 (5.0) | 3.30 W/g (4000 rpm) - 15 min | — | — | — |

Magnetic Toner Production Examples 2 to 31

Magnetic toners 2 to 31 were obtained proceeding as for magnetic toner 1, but using the formulations, e.g., the binder resin and magnetic body used, shown in Table 4 and changing the external addition and mixing conditions as shown in Table 5. The properties of magnetic toners 2 to 31 are given in Table 6.

Comparative Magnetic Toner Production Examples 1 to 11

Comparative magnetic toners 1 to 11 were obtained proceeding as for magnetic toner 1, but using the formulations, e.g., the binder resin and magnetic body used, shown in Table 4 and changing the external addition and mixing conditions as shown in Table 5. The properties of comparative magnetic toners 1 to 11 are given in Table 6.

TABLE 6

Properties of the magnetic toners and comparative magnetic toners

| | amount of weakly fixed silica fine particles (mass parts) | ratio of amount of medium-fixed silica fine particles to amount of weakly fixed silica fine particles (—) | coverage ratio X by strongly fixed silica fine particles (%) | particle diameter ratio for the silica fine particles (*1) | ε' (pF/m) | acid value (mgKOH/g) | average circularity (—) | maximum endothermic peak temperature (° C.) | saturation magnetization σs ($Am^2/kg$) | residual magnetization σr ($Am^2/kg$) | σr/σs (—) |
|---|---|---|---|---|---|---|---|---|---|---|---|
| magnetic toner 1 | 0.21 | 2.7 | 72.0 | 10.0 | 34.0 | 15 | 0.958 | 72.0 | 33.0 | 2.3 | 0.07 |
| magnetic toner 2 | 0.12 | 4.7 | 73.0 | 10.0 | 34.0 | 15 | 0.958 | 72.0 | 33.0 | 2.3 | 0.07 |
| magnetic toner 3 | 0.13 | 2.1 | 72.5 | 10.0 | 34.1 | 15 | 0.958 | 72.0 | 33.0 | 2.3 | 0.07 |
| magnetic toner 4 | 0.28 | 4.3 | 72.8 | 10.0 | 34.0 | 15 | 0.958 | 72.0 | 33.0 | 2.3 | 0.07 |
| magnetic toner 5 | 0.27 | 2.1 | 72.6 | 10.0 | 34.1 | 15 | 0.958 | 72.0 | 33.0 | 2.3 | 0.07 |
| magnetic toner 6 | 0.26 | 2.2 | 87.0 | 10.0 | 34.0 | 15 | 0.958 | 72.0 | 33.0 | 2.3 | 0.07 |
| magnetic toner 7 | 0.18 | 4.2 | 61.5 | 10.0 | 34.0 | 15 | 0.958 | 72.0 | 33.0 | 2.3 | 0.07 |
| magnetic toner 8 | 0.20 | 3.0 | 71.8 | 10.0 | 34.0 | 15 | 0.958 | 72.0 | 33.0 | 2.3 | 0.07 |
| magnetic toner 9 | 0.22 | 2.7 | 71.9 | 10.0 | 34.2 | 15 | 0.956 | 72.0 | 33.0 | 3.0 | 0.09 |
| magnetic toner 10 | 0.23 | 2.7 | 71.9 | 10.0 | 34.0 | 15 | 0.957 | 72.0 | 33.0 | 3.6 | 0.11 |
| magnetic toner 11 | 0.22 | 2.7 | 72.1 | 10.0 | 34.1 | 15 | 0.958 | 54.0 | 33.0 | 3.6 | 0.11 |
| magnetic toner 12 | 0.21 | 2.9 | 71.9 | 10.0 | 33.9 | 15 | 0.958 | 67.2 | 33.0 | 3.6 | 0.11 |
| magnetic toner 13 | 0.20 | 3.0 | 72.0 | 10.0 | 34.0 | 15 | 0.957 | 78.2 | 33.0 | 3.6 | 0.11 |
| magnetic toner 14 | 0.20 | 2.7 | 71.9 | 10.0 | 34.1 | 15 | 0.958 | 43.2 | 33.0 | 3.6 | 0.11 |
| magnetic toner 15 | 0.23 | 2.6 | 71.9 | 10.0 | 34.0 | 15 | 0.958 | 67.0 | 33.0 | 3.6 | 0.11 |
| magnetic toner 16 | 0.24 | 2.4 | 72.1 | 10.0 | 33.9 | 15 | 0.956 | 75.1 | 33.0 | 3.6 | 0.11 |
| magnetic toner 17 | 0.25 | 2.5 | 72.0 | 10.0 | 34.0 | 15 | 0.956 | 83.2 | 33.0 | 3.6 | 0.11 |
| magnetic toner 18 | 0.22 | 2.8 | 72.2 | 10.0 | 31.8 | 6.5 | 0.957 | 83.2 | 33.0 | 3.6 | 0.11 |
| magnetic toner 19 | 0.23 | 2.7 | 71.9 | 10.0 | 36.5 | 43 | 0.958 | 83.2 | 33.0 | 3.6 | 0.11 |
| magnetic toner 20 | 0.22 | 2.7 | 72.0 | 10.0 | 33.8 | 11 | 0.958 | 83.2 | 33.0 | 3.6 | 0.11 |
| magnetic toner 21 | 0.20 | 3.1 | 72.3 | 10.0 | 35.8 | 39 | 0.957 | 83.2 | 33.0 | 3.6 | 0.11 |
| magnetic toner 22 | 0.21 | 2.9 | 71.9 | 10.0 | 36.7 | 43 | 0.952 | 83.2 | 33.0 | 3.6 | 0.11 |
| magnetic toner 23 | 0.23 | 2.7 | 72.0 | 10.0 | 33.0 | 43 | 0.951 | 83.2 | 31.8 | 3.5 | 0.11 |
| magnetic toner 24 | 0.22 | 2.7 | 71.9 | 10.0 | 39.2 | 43 | 0.952 | 83.2 | 37.3 | 4.1 | 0.11 |
| magnetic toner 25 | 0.22 | 2.7 | 72.1 | 10.0 | 27.0 | — | 0.953 | 83.2 | 33.0 | 3.6 | 0.11 |
| magnetic toner 26 | 0.23 | 2.7 | 71.9 | 10.0 | 41.2 | 43 | 0.953 | 83.2 | 38.2 | 4.2 | 0.11 |
| magnetic toner 27 | 0.18 | 4.2 | 67.5 | 24.3 | 34.0 | 15 | 0.958 | 72.0 | 33.0 | 3.6 | 0.11 |
| magnetic toner 28 | 0.19 | 3.8 | 63.2 | 17.3 | 34.1 | 15 | 0.957 | 72.0 | 33.0 | 3.6 | 0.11 |
| magnetic toner 29 | 0.22 | 2.8 | 72.1 | 3.7 | 33.9 | 15 | 0.957 | 72.0 | 33.0 | 3.6 | 0.11 |
| magnetic toner 30 | 0.28 | 2.1 | 86.5 | 4.2 | 34.0 | 15 | 0.958 | 72.0 | 33.0 | 3.6 | 0.11 |
| magnetic toner 31 | 0.22 | 2.7 | 89.2 | 2.7 | 34.0 | 15 | 0.957 | 72.0 | 33.0 | 3.6 | 0.11 |
| comparative magnetic toner 1 | 0.15 | 4.7 | 41.2 | 10.0 | 33.9 | 15 | 0.958 | 72.0 | 33.0 | 3.6 | 0.11 |
| comparative magnetic toner 2 | 0.26 | 2.1 | 93.0 | 10.0 | 34.2 | 15 | 0.957 | 72.0 | 33.0 | 3.6 | 0.11 |
| comparative magnetic toner 3 | 0.12 | 8.3 | 72.1 | 10.0 | 34.1 | 15 | 0.957 | 72.0 | 33.0 | 3.6 | 0.11 |
| comparative magnetic toner 4 | 0.08 | 4.1 | 71.9 | 10.0 | 34.0 | 15 | 0.958 | 72.0 | 33.0 | 3.6 | 0.11 |
| comparative magnetic toner 5 | 0.11 | 1.8 | 72.3 | 10.0 | 33.9 | 15 | 0.956 | 72.0 | 33.0 | 3.6 | 0.11 |
| comparative magnetic toner 6 | 0.28 | 7.1 | 72.0 | 10.0 | 34.0 | 15 | 0.958 | 72.0 | 33.0 | 3.6 | 0.11 |
| comparative magnetic toner 7 | 0.35 | 4.8 | 72.1 | 10.0 | 33.9 | 15 | 0.957 | 72.0 | 33.0 | 3.6 | 0.11 |
| comparative magnetic toner 8 | 0.28 | 1.8 | 71.8 | 10.0 | 34.0 | 15 | 0.958 | 72.0 | 33.0 | 3.6 | 0.11 |
| comparative magnetic toner 9 | 0.35 | 2.1 | 72.2 | 10.0 | 34.0 | 15 | 0.957 | 72.0 | 33.0 | 3.6 | 0.11 |
| comparative magnetic toner 10 | 0.23 | 2.8 | 25.0 | — | 34.0 | 15 | 0.956 | 72.0 | 33.0 | 3.6 | 0.11 |
| comparative magnetic toner 11 | 0.26 | 12.5 | 47.2 | — | 34.0 | 15 | 0.956 | 72.0 | 33.0 | 3.6 | 0.11 |

(*1) Represents the ratio of the number-average particle diameter (D1) of the primary particles of the strongly fixed silica fine particles (third inorganic fine particles) to the number-average particle diameter (D1) of the primary particles of the weakly fixed silica fine particles(first inorganic fine particles).

In addition, the amount of weakly fixed silica fine particles represents the content in 100 mass parts of the magnetic toner.

Example 1

The Image-Forming Apparatus

An LBP-3100 (Canon, Inc.) equipped with a small-diameter developing sleeve with a diameter of 10 mm was used as the image-forming apparatus; the printing speed of this apparatus was modified from 16 prints/minute to 32 prints/minute. The durability can be rigorously evaluated in an image-forming apparatus equipped with a small-diameter developing sleeve by modifying the printing speed to 32 prints/minute.

Tests were carried out using this modified apparatus in which 10,000 prints of a horizontal line image with a print density of 1% were output in single-sheet intermittent mode in a high-temperature, high-humidity environment (32.5° C./80% RH).

After the 10,000 prints had been output, standing was carried out for a day in the high-temperature, high-humidity environment and additional prints were then output.

As a result, images could be obtained that had a high density both before and after the durability test and that presented little fogging in nonimage areas. In addition, the charge distribution in the magnetic toner was evaluated after the 10,000 print output. The results were also a very sharp charge distribution.

The results are given in Table 7.

Here, the amount of charge on the magnetic toner particles was measured using an Espart Analyzer from Hosokawa Micron Corporation. The Espart Analyzer is an instrument that measures the particle diameter and amount of charge by introducing the sample particles into a detection section (measurement section) in which both an electrical field and an acoustic field are formed at the same time and measuring the velocity of particle motion by the laser doppler technique. The sample particle that has entered the measurement section of the instrument is subjected to the effects of the acoustic field and electrical field and falls while undergoing deflection in the horizontal direction, and the beat frequency of the velocity in this horizontal direction is counted. The count value is input by interrupt to a computer, and the particle diameter distribution or the charge distribution per unit particle diameter is displayed on the computer screen in real time. Once the amount of charge on a prescribed number has been measured, the screen is terminated and subsequent to this, for example, the three-dimensional distribution of amount of charge and particle diameter, the charge distribution by particle diameter, the average amount of charge (coulomb/weight), and so forth, is displayed on the screen. By introducing a magnetic toner as the sample particles into the measurement section of the Espart Analyzer, the amount of charge on the magnetic toner can be measured and the relationship between particle diameter and amount of charge can be evaluated from the charging performance of the magnetic toner.

In the present invention, the charge distribution on the developing sleeve was evaluated by introducing the magnetic toner layer on the developing sleeve into the measurement section.

When the uniformity of the amount of charge on the developing sleeve is not satisfactory, the charge distribution assumes a broad shape and, in particular due to the effect of the excess-charged magnetic toner of the developing sleeve lower layer, magnetic toner with a low charging performance is then counted as an inversion component.

The evaluation methods and their scoring criteria are described below for each of the evaluations carried out in the examples of the present invention and the comparative examples.

<The Image Density>

For the image density, a solid image area was formed and the density of this solid image was measured with a MacBeth reflection densitometer (MacBeth Corporation).

A better result was indicated by a smaller difference between the reflection density of the solid image at the start of the durability test and the reflection density of the solid image after use in the 10,000 print durability test.

A: superior (less than 0.05)
B: excellent (from at least 0.05 to less than 0.15)
C: ordinary (from at least 0.15 to less than 0.25)
D: poor (equal to or greater than 0.25)

<Fogging>

A white image was output and its reflectance was measured using a REFLECTMETER MODEL TC-6DS from Tokyo Denshoku Co., Ltd. On the other hand, the reflectance was also measured in the same manner on the transfer paper (standard paper) prior to formation of the white image. A green filter was used for the filter. The fogging was calculated using the following formula from the reflectance prior to output of the white image and the reflectance after output of the white image.

fogging(reflectance)(%)=reflectance(%) of the standard paper−reflectance(%) of the white image sample The scoring criteria for fogging are as follows.

A: superior (less than 0.5%)
B: excellent (from at least 0.5% to less than 1.5%)
C: ordinary (from at least 1.5% to less than 3.0%)
D: poor (equal to or greater than 3.0%)

<The Charge Distribution>

For the evaluation of the charge distribution, standing was carried out for 1 day after use in the 10,000-print durability test and, using the Espart Analyzer, the amount of charge on the magnetic toner on the developing sleeve was measured and the charge distribution was analyzed. The scoring criteria for the charge distribution are as follows.

The magnetic toner population detected as inversion component is:

A: less than 5.0%
B: at least 5.0%, but less than 10.0%
C: at least 10.0%, but less than 20.0%
D: at least 20.0%

<The Low-Temperature Fixability>

The low-temperature fixability was evaluated by reducing the heater temperature in the fixing unit by 20° C. at the start of the durability test. The scoring criteria for the low-temperature fixability are given below.

A: The solid image does not stick to the finger even when rubbed.
B: The solid image sticks to the finger somewhat when rubbed, but the text image and so forth are unproblematic.
C: When rubbed strongly, there are locations for both the solid image and the text image that come off.

Examples 2 to 31 and Comparative Examples 1 to 11

Using magnetic toners 2 to 31 and comparative magnetic toners 1 to 11 as the magnetic toner, evaluations were performed using the same conditions as for Example 1. The results of the evaluations are given in Table 7.

TABLE 7

Results of the evaluations in the examples and comparative examples

| | toner evaluated | evaluation 1 (charge distribution) | evaluation 2 (image density) | evaluation 3 (fogging) | evaluation 4 (low-temperature fixability) |
|---|---|---|---|---|---|
| Example 1 | magnetic toner 1 | A | A (0.03) | A (0.2) | A |
| Example 2 | magnetic toner 2 | A | A (0.03) | A (0.2) | A |
| Example 3 | magnetic toner 3 | A | A (0.03) | A (0.2) | A |
| Example 4 | magnetic toner 4 | A | A (0.03) | A (0.2) | A |
| Example 5 | magnetic toner 5 | A | A (0.03) | A (0.2) | A |
| Example 6 | magnetic toner 6 | A | A (0.03) | A (0.2) | A |
| Example 7 | magnetic toner 7 | A | A (0.03) | A (0.4) | A |
| Example 8 | magnetic toner 8 | A | A (0.04) | B (0.6) | A |
| Example 9 | magnetic toner 9 | A | B (0.06) | B (0.8) | A |
| Example 10 | magnetic toner 10 | B | B (0.09) | B (1.0) | A |
| Example 11 | magnetic toner 11 | B | B (0.09) | B (1.0) | A |
| Example 12 | magnetic toner 12 | B | B (0.09) | B (1.0) | A |
| Example 13 | magnetic toner 13 | B | B (0.09) | B (1.0) | B |
| Example 14 | magnetic toner 14 | B | C (0.15) | B (1.3) | A |
| Example 15 | magnetic toner 15 | B | C (0.16) | B (1.3) | B |
| Example 16 | magnetic toner 16 | B | B (0.09) | B (1.1) | C |
| Example 17 | magnetic toner 17 | B | B (0.10) | B (1.2) | C |
| Example 18 | magnetic toner 18 | B | B (0.08) | C (1.5) | C |
| Example 19 | magnetic toner 19 | B | C (0.16) | B (1.1) | C |
| Example 20 | magnetic toner 20 | B | B (0.09) | B (1.3) | C |
| Example 21 | magnetic toner 21 | B | B (0.10) | B (1.1) | C |
| Example 22 | magnetic toner 22 | C | C (0.16) | C (1.6) | C |
| Example 23 | magnetic toner 23 | C | C (0.17) | C (1.7) | C |
| Example 24 | magnetic toner 24 | C | C (0.18) | C (1.7) | C |
| Example 25 | magnetic toner 25 | C | C (0.24) | C (2.6) | C |
| Example 26 | magnetic toner 26 | C | C (0.19) | C (2.0) | C |
| Example 27 | magnetic toner 27 | B | B (0.10) | B (1.0) | A |
| Example 28 | magnetic toner 28 | B | B (0.11) | B (1.0) | A |
| Example 29 | magnetic toner 29 | B | C (0.18) | B (1.3) | A |
| Example 30 | magnetic toner 30 | B | B (0.13) | C (1.5) | A |
| Example 31 | magnetic toner 31 | B | C (0.20) | C (1.9) | A |
| Comparative Example 1 | comparative magnetic toner 1 | D | D (0.31) | C (2.7) | A |
| Comparative Example 2 | comparative magnetic toner 2 | B | B (0.08) | B (1.1) | C |
| Comparative Example 3 | comparative magnetic toner 3 | D | C (0.21) | B (1.4) | A |
| Comparative Example 4 | comparative magnetic toner 4 | D | B (0.13) | C (2.6) | A |
| Comparative Example 5 | comparative magnetic toner 5 | D | C (0.22) | D (3.2) | A |
| Comparative Example 6 | comparative magnetic toner 6 | D | B (0.14) | B (1.3) | B |
| Comparative Example 7 | comparative magnetic toner 7 | D | C (0.21) | B (1.4) | B |
| Comparative Example 8 | comparative magnetic toner 8 | D | C (0.22) | D (3.3) | A |
| Comparative Example 9 | comparative magnetic toner 9 | D | C (0.23) | C (2.7) | A |
| Comparative Example 10 | comparative magnetic toner 10 | D | C (0.22) | C (2.4) | A |
| Comparative Example 11 | comparative magnetic toner 11 | D | C (0.23) | C (2.5) | C |

REFERENCE SIGNS LIST

51: magnetic toner particle, 52: autofeeder, 53: feed nozzle, 54: surface modification apparatus interior, 55: hot air current introduction port, 56: cold air current introduction port, 57: surface-modified magnetic toner particle, 58: cyclone, 59: blower

1: main casing, 2: rotating member, 3, 3*a*, 3*b*: stirring member, 4: jacket, 5: raw material inlet port, 6: product discharge port, 7: central axis, 8: drive member, 9: processing space, 10: end surface of the rotating member, 11: direction of rotation, 12: back direction, 13: forward direction, 16: raw material inlet port inner piece, 17: product discharge port inner piece, d: distance that represents the overlapping portion of a stirring member, D: stirring member width

100: electrostatic latent image-bearing member (photoreceptor), 102: developing sleeve, 114: transfer member (transfer roller), 116: cleaner, 117: charging member (charging roller), 121: laser generator (latent image-forming means, photoexposure device), 123: laser, 124: register roller, 125: transport belt, 126: fixing unit, 140: developing device, 141: stirring member While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-269142, filed Dec. 26, 2013, which is hereby incorporated by reference herein in its entirety.

The invention claimed is:

1. A magnetic toner comprising:

a magnetic toner particle containing a binder resin and a magnetic body with inorganic fine particles fixed to the surface of the magnetic toner particle, wherein when the inorganic fine particles are classified in accordance with fixing strength thereof to the magnetic toner particle and in the sequence of the weakness of the fixing strength, as first inorganic fine particles having weak fixing strength that are detached when a dispersion prepared by addition of the magnetic toner to surfactant-containing ion-exchanged water is shaken for 2 minutes at a shaking velocity of 46.7 cm/sec and a shaking amplitude of 4.0 cm, second inorganic fine particles having medium fixing strength that are not detached by the shaking, but are detached by ultrasound dispersion for 30 minutes at an intensity of 120 $W/cm^2$, third inorganic fine particles having strong fixing strength that are not detached by the shaking and the ultrasound dispersion, the number-average particle diameter (D1) of the primary particles of the third inorganic fine particles being from 50 to 200 nm, the third inorganic fine particles are silica fine particles, and the number average particle diameter (D1) of the primary particles of the first inorganic fine particles and/or the second inorganic fine particles being from 5 nm to 30 nm, 1) the content of the first inorganic fine particles is 0.10 to 0.30 mass parts in 100 mass parts of the magnetic toner;

2) the second inorganic fine particles are present at 2.0 to 5.0-times the first inorganic fine particles;

3) the coverage ratio X of coverage of the magnetic toner surface by the third inorganic fine particles is 60.0 to 90.0 area % as determined with an x-ray photoelectron spectrometer; and 4) the content of the third inorganic fine particles is 2.5 to 4.0 mass parts in 100 mass parts of the magnetic toner particle.

2. The magnetic toner according to claim 1, wherein said first and second inorganic fine particles fixed to the magnetic toner particle surface comprise silica fine particles.

3. The magnetic toner according to claim 1, wherein the ratio of the number-average particle diameter (D1) of primary particles of the third inorganic silica fine particles to the number-average particle diameter (D1) of the primary particles of the first inorganic fine particles is 4.0 to 25.0.

4. The magnetic toner according to claim 1, wherein the dielectric constant ε' of the magnetic toner at a frequency of 100 kHz and a temperature of 30° C. is 30.0 to 40.0 pF/m.

5. The magnetic toner according to claim 1, wherein the average circularity of the magnetic toner is at least 0.955.

6. The magnetic toner according to claim 1, wherein the acid value of the magnetic toner is 10 to 40 mg KOH/g.

7. The magnetic toner according to claim 1, wherein the saturation magnetization (σs) of the magnetic toner is 30.0 to 40.0 $Am^2/kg$ and the ratio [σr/σs] between the residual magnetization (σr) of the magnetic toner and the saturation magnetization (σs) is 0.03 to 0.10.

8. The magnetic toner according to claim 2, wherein the magnetic toner additionally contains titania fine particles.

9. The magnetic toner according to claim 1, wherein the magnetic toner contains an ester compound as a release agent and has a maximum endothermic peak of 50 to 80° C. as measured with a differential scanning calorimeter.

10. The magnetic toner according to claim 1, wherein the number average particle diameter (D1) of the primary particles of the third inorganic silica fine particles is from 60 to 180 nm.

11. The magnetic toner according to claim 1, wherein the first inorganic fine particles and the second inorganic fine particles are at least one member independently selected from the group consisting of silica fine particles, titania fine particles, and alumina fine particles.

12. The magnetic toner according to claim 9, wherein the ester compound is a monofunctional ester compound having from 32 to 48 carbons.

* * * * *